US007272331B2

(12) United States Patent
Kobayashi et al.

(10) Patent No.: US 7,272,331 B2
(45) Date of Patent: Sep. 18, 2007

(54) IMAGE FORMING APPARATUS

(75) Inventors: Tetsuya Kobayashi, Numazu (JP); Yasuomi Aso, Numazu (JP); Kentaro Kawata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 11/033,735

(22) Filed: Jan. 13, 2005

(65) Prior Publication Data

US 2005/0185975 A1 Aug. 25, 2005

(30) Foreign Application Priority Data

Jan. 14, 2004 (JP) ..... 2004-006883

(51) Int. Cl.
*G03G 15/00* (2006.01)
*G03G 21/20* (2006.01)

(52) U.S. Cl. ..... 399/44; 399/53

(58) Field of Classification Search ..... 399/44, 399/53

See application file for complete search history.

(56) References Cited

U.S. PATENT DOCUMENTS 4,757,349 A * 7/1988 Toshimitsu et al. ..... 399/346
4,772,916 A * 9/1988 Mochida ..... 399/227
4,797,707 A * 1/1989 Iwahashi et al. ..... 399/43
4,801,980 A * 1/1989 Arai et al. ..... 399/29
5,148,218 A * 9/1992 Nakane et al. ..... 399/9
6,694,108 B2 * 2/2004 Hirose et al. ..... 399/44
7,085,506 B2 * 8/2006 Forbes et al. ..... 399/29
2001/0046388 A1 * 11/2001 Inoue et al. ..... 399/44

FOREIGN PATENT DOCUMENTS

| | | |
|---|---|---|
| JP | 8-314253 | 11/1996 |
| JP | 9-34243 | 2/1997 |
| JP | 10-133531 | 5/1998 |
| JP | 2000-181216 | 6/2000 |
| JP | 3389354 | 1/2003 |

* cited by examiner

*Primary Examiner*—Anjan Deb
(74) *Attorney, Agent, or Firm*—Fitzpatrick, Cella, Harper & Scinto

(57) ABSTRACT

An image forming apparatus includes an image bearing member; a developing device for developing an electrostatic image formed on the image bearing member with a developer into a developed image; transferring means for transferring the developed image onto an image receiving member; cleaning member, contacted to the image bearing member, for removing a residual developer from the image bearing member; detecting means for detecting an ambient condition of the apparatus; wherein the developing device is capable of transferring a developer onto a non-image formation region of the image bearing member, and the developer on the non-image formation region reaches a cleaning position of the cleaning member; and wherein an operation of transferring the developer onto the non-image formation region is controlled in accordance with an output of the detecting means.

20 Claims, 11 Drawing Sheets

IMAGE FORMING APPARATUS

FIELD OF THE INVENTION AND RELATED ART

The present invention generally relates to an image forming apparatus which forms an electrophotographic image on an image bearing member with the use of an electrophotographic or electrostatic recording method, and develops the electrostatic latent image with the use of the developer in the developing apparatus. In particular, it relates to an image forming apparatus which forces developer to transfer onto the image bearing member while it is not forming an image.

Conventionally, the image forming process of an image forming apparatus, for example, an electrophotographic image forming apparatus, is as follows: First, the peripheral surface of an electrophotographic photosensitive member (photosensitive drum), as an image bearing member, in the form of a drum, is uniformly charged by a charging apparatus, and the charged peripheral surface of the photosensitive drum is exposed to form an electrophotographic image on the peripheral surface of the photosensitive drum. Then, the electrostatic latent image is developed, by a developing apparatus, into an image formed of developer (toner) (which hereinafter may be referred to as developer image or toner image). The toner image is transferred onto transfer medium, for example, printing paper, by a transferring apparatus. After the transfer of the toner image onto the transfer medium, the toner image is permanently fixed to the transfer medium by a fixing apparatus. Then, the transfer medium, bearing the permanent toner image, is outputted as a final product (copy) from the main assembly of the image forming apparatus. The toner which remained on the peripheral surface of the photosensitive drum after the toner image transfer, is removed by a cleaning apparatus, to prepare the photosensitive drum for the following image forming operation.

Regarding the development step among the plurality of the image formation steps in the image forming process carried out by an image forming apparatus such as the above described one, if a developing apparatus is relatively small in terms of the size of area by which it can develop the latent image per unit length of time, that is, the ratio of the area of a latent image which can be developed per rotation of the developing roller of the developing apparatus, to the total area of the image, is relatively small, the developing apparatus has to be driven for a relatively long time, causing thereby the toner therein to deteriorate to a relatively greater degree. As for the examples of the deterioration, the toner particles become nonuniform in shape, and/or the toner becomes abnormal in its particle diameter distribution. Further, the external additives, such as silica or the like, which were added to the toner to improve the toner in fluidity and/or triboelectrical chargeability, are buried into the peripheral surfaces of the toner particles, creating various problems. For example, the toner is reduced in chargeability and/or developmental performance. The reduction in the developmental performance of the toner results in the formation of an image insufficient in color density, whereas the reduction in the triboelectrical chargeability of the toner results in the formation of an image suffering from fog.

Moreover, a developing apparatus, in accordance with the prior art, which employs single-component developer suffers from the following problem, in addition to the above described ones. That is, a developing apparatus comprises a developer bearing member, which bears toner on its peripheral surface, and is rotated so that the toner borne on its peripheral surface is conveyed to the photosensitive drum. More specifically, as the developer bearing member is rotated, the body of the toner borne on the peripheral surface of the developer bearing member is formed into a uniform layer of the toner, with a predetermined thickness, by a development blade, and then, is supplied to the photosensitive drum. Thus, as the developer bearing member of a developing apparatus such as the above described one is driven for a long time for the above described reason, the toner is rubbed a substantial number times by the development blade. Therefore, the developing apparatus suffers from the problem that toner adheres to the development blade, in addition to the above described problems.

There have been made various proposals to solve the above described problems.

For example, as the countermeasures against the formation of an image which suffers from abnormally low color density and/or the fog, and also, as the countermeasure against the toner adhesion to a development blade, which are attributable to toner deterioration, there is Japanese Patent 2787009. In the case of the image forming apparatus disclosed in this patent, the developer on the peripheral surface of the developer bearing member is forced to transfer onto the portions of the image bearing member, on which no image is formed, that is, it is removed (consumed) as necessary, in accordance with the values which are related to the amount of developer consumption and are detected by the detecting means, in order to prevent the electrostatic force between the developer and developer bearing member from becoming excessive. Therefore, it is ensured that satisfactory images will be continuously formed.

In the case of the developing apparatus disclosed in Japanese Patent 3389354, the average black area ratio is calculated based on a black pixel counter and a recording medium counter, and an image is written on the image bearing member during the image formation intervals in order to prevent toner from adhering to the toner regulating means, and also, to prevent the formation of abnormal copies, that is, copies, the recording medium of which are soiled, or the like.

In the case of the image forming apparatus disclosed in Japanese Laid-open Patent Application 10-133531, the deteriorated toner adhering to the development roller is periodically (with predetermined intervals) removed by forcing the deteriorated toner to transfer onto the photosensitive drum for every predetermined number of copies while images are formed by the image forming apparatus. Therefore, the image forming apparatus is prevented from reducing in print quality; it is prevented from forming an image suffering from fog.

As for the countermeasures against toner deterioration, more specifically, measures for preventing toner from changing in shape and/or condition, and also, preventing external additives from being buried into the toner particles, Japanese Laid-open Patent Application 8-314253 discloses a method for satisfactorily supplying toner. In the case of the image forming apparatus disclosed in this patent application, the type of toner deterioration attributable to the friction which occurs as the toner is stirred in the toner storage container is prevented by consuming toner by forcing toner to transfer onto the photosensitive drum during the period in which the developer in the developer storage container is stirred no less than a predetermined length of time while no toner in the developer storage container is consumed, or the developer storage container is not supplied with toner.

In the case of the image forming apparatus disclosed in Japanese Laid-open Patent Application 9-34243, image ratio is calculated for each copy, based on the inputted image formation data, and when the image ratio is no more than a predetermined value, not only is toner consumed by forcing toner to transfer onto the photosensitive drum, but also, the developing apparatus is supplied with toner by the amount equal to the amount by which toner is forced to transfer onto the photosensitive drum. Therefore, even when a substantial number of images which are small in toner consumption are continuously outputted, the image forming apparatus does not reduce in image quality; it does not output images suffering from low density, or the like.

There are also measures for preventing the length of development time from becoming longer. For example, in the case of the image forming apparatus disclosed in Japanese Laid-open Patent Application 2000-181216, the length of time the developing apparatus is driven is measured, and each time the cumulative length of time the developing apparatus was driven reaches a predetermined value, the image forming apparatus is operated in an operational mode, in which an image is not formed, and toner is forced to transfer onto the photosensitive drum. Therefore, even when an image, which is small in terms of the image ratio of a latent image, is continuously outputted by a substantial number, the cumulative length of time the driving apparatus will be operated before the service life of the developer in the developing apparatus ends will be no more than a predetermined value. Therefore, it is possible to prevent the problem that after the developing apparatus is provided with a fresh supply of developer, the image forming apparatus outputs images which are soiled across the background portions thereof. In other words, the toner in the developing apparatus is initialized by consuming the deteriorated toner in the developing apparatus by forcing the toner from the developing apparatus onto the photosensitive drum with predetermined timing during periods in which no image is formed.

After toner is forced to transfer onto the photosensitive drum, the photosensitive drum is cleaned; the toner on the photosensitive drum on the photosensitive drum is scraped down from the photosensitive drum by the cleaning apparatus as disclosed in Japanese Laid-open Patent Applications 10-133531, 8-314253, etc.

The method for initializing the toner in the developing apparatus, by consuming the deteriorated toner in the developing apparatus is preferably carried out. As for the method for determining the amount by which toner is to be forced to transfer from the developing apparatus onto the photosensitive drum, it is desired to be equal to the amount of the deteriorated toner in the developing apparatus. More specifically, it is desired to be equal to the amount by which toner is borne on the developer bearing member per rotation thereof. Further, in the case of a developing apparatus provided with a toner supplying member which is placed in contact with the developer bearing member to convey toner to the developer bearing member and supply the developer bearing member with toner, the amount by which toner is to be forced to transfer onto the photosensitive drum is desired to be equal to the greater of the amount by which toner is borne on the developer bearing member per full rotation thereof, and the amount by which toner is borne on the developer supplying member per full rotation of the developer supplying member.

However, in the case of any of the image forming apparatuses structured as described above, the amount by which toner has to be forced to transfer onto the photosensitive drum in order to force the deteriorated toner in the developing apparatus to efficiently transfer from the developing apparatus onto the photosensitive drum is substantial; it has to be no less than the amount by which toner is borne on each of the abovementioned members in the developing apparatus per rotation thereof.

Further, the above described control is carried out while no image is formed. Therefore, the toner having transferred onto the photosensitive drum is recovered into the cleaning apparatus without being subjected to the transfer step in which the toner on the photosensitive drum is transferred onto transfer medium or the like. Therefore, the amount by which toner is recovered into the cleaning apparatus, that is, the amount of the toner which is forced to transfer onto the photosensitive drum, while the image forming apparatus is under the above described control, is substantially greater than the amount of the transfer residual toner, or the toner remaining on the photosensitive drum after the image transfer, that is, the toner having failed to be transferred onto the transfer medium while an image is formed. Therefore, the amount of the load to which the cleaning apparatus is subjected while the image forming apparatus is under this control is greater. However, even when the image forming apparatus was under this control, as long as the internal ambience of the image forming apparatus was normal, that is, the internal temperature and/or humidity of the image forming apparatus were in the range of 15° C.-25° C., and in the range of 30% RH-60% RH, respectively, it did not occur that the cleaning apparatus fails to satisfactorily clean photosensitive drum.

However, when the internal temperature and/or internal humidity of the image forming apparatus is lower than a certain level below which some elastic substances reduce in resiliency, the control in accordance with the prior art suffered from the following problem. That is, the cleaning blade of the cleaning apparatus, which is an elastic blade formed of well-known elastic substance such as urethane rubber, silicone rubber, or the like. Therefore, when the internal temperature and/or internal humidity of the image forming apparatus is lower than the certain level, it is slower in flexing speed, failing therefore to remain in contact with the peripheral surface of the photosensitive drum, which is uneven in terms of microscopic level. Therefore, the cleaning apparatus fails to satisfactorily clean the photosensitive drum.

SUMMARY OF THE INVENTION

The primary object of the present invention is to provide an image forming apparatus in which deteriorated toner is prevented from remaining in the developing apparatus, by transferring developer from the developing apparatus onto the image bearing member while no image is formed.

Another object of the present invention is to provide an image forming apparatus in which unsatisfactory cleaning does not occur even when its internal ambience is abnormal, more specifically, even when its internal temperature and/or humidity is lower than a predetermined level.

Another object of the present invention is to provide an image forming apparatus which outputs images of good quality, that is, images which do not suffer from the fog and/or low density attributable to the developer deterioration in its developing apparatus.

Another object of the present invention is to provide an image forming apparatus which determines the amount by which developer is to be transferred from its developing apparatus onto its image bearing member, in accordance with the outputs of its means for detecting the state of its internal ambience.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described in more detail with reference to the appended drawings.

Embodiment 1

First, referring to FIGS. 1-4, the image forming apparatus in the first embodiment of the present invention will be described in detail.

The image forming apparatus in this embodiment is a printer which outputs an image based on the image formation data from a host computer. It comprises a single or plurality of process cartridges in which a photosensitive drum as an image bearing member, and such consumables as developer (toner), etc., are disposed, and which are removably mountable in the main assembly of the image forming apparatus.

Figure 1:
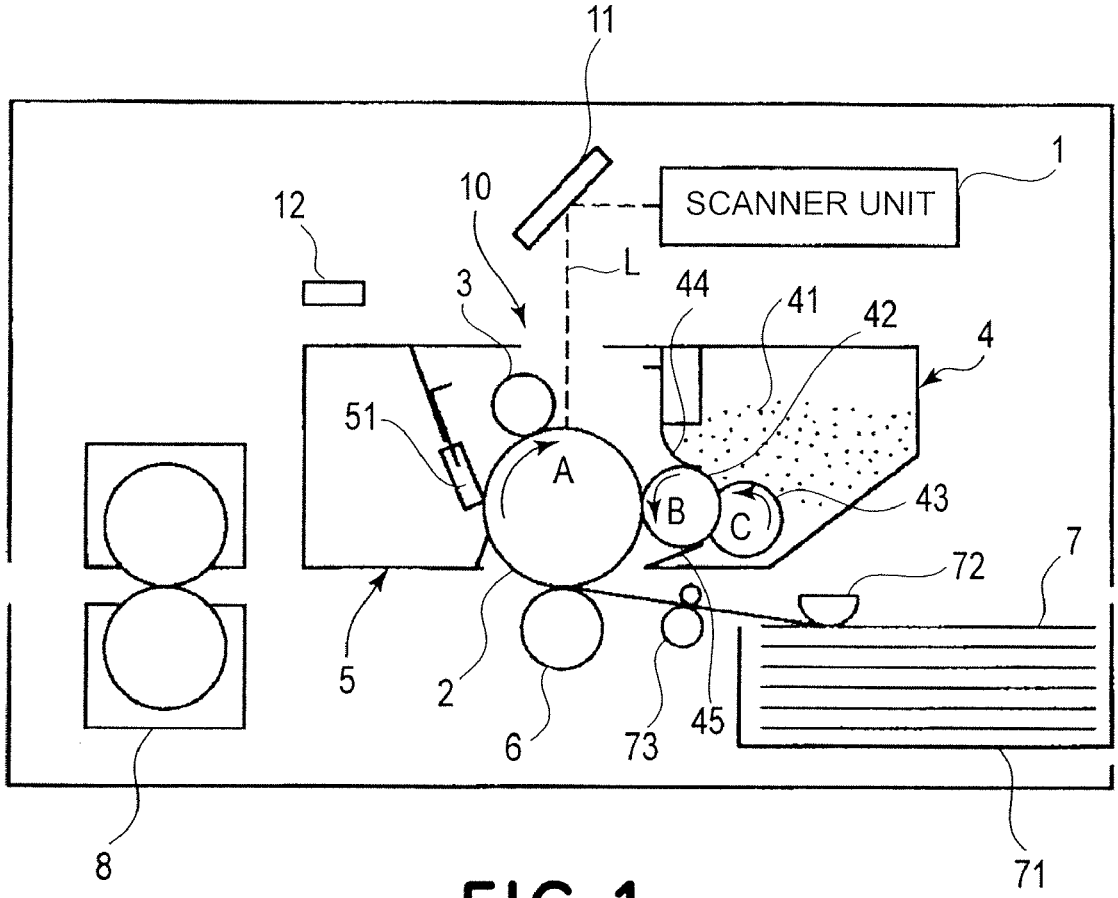
FIG. 1 is a schematic drawing of an example of the image forming apparatus in accordance with the present invention, showing the general structure thereof.

FIG. 1 is a schematic drawing of the image forming apparatus in this embodiment. As shown in FIG. 1, in the normal image formation process for forming an image desired by a user with the use of the image forming apparatus in this embodiment, the photosensitive drum 2 as an image bearing member is rotationally driven in the direction indicated by an arrow mark A, and is uniformly charged (charging step) by a primary charging device 3 comprising a charge roller. In this embodiment, the peripheral velocity of the photosensitive drum 2 is 94.2 mm/sec, and the potential level Vd (dark point potential level) of the peripheral surface of the photosensitive drum 2 after the uniform charging of the photosensitive drum 2 by the primary charging device 3 is −500 V (Vd=−500 V).

The image forming method employed by the image forming apparatus in this embodiment is one of the electrophotographic image forming methods. Therefore, in the latent image formation step (exposing step), a beam of laser light L is outputted from the scanner unit 1, as an exposing apparatus, comprising a laser, a polygon mirror, and a lens system, while being modulated in accordance with video signals, and is reflected (deflected) by a deflection mirror 11 so that the beam of laser light L is projected onto the peripheral surface of the photosensitive drum 2. As the peripheral surface of the photosensitive drum 2, which has just been uniformly charged to −500 V, is scanned by the beam of laser light L, the numerous points of the uniformly charged peripheral surface of the photosensitive drum 2 are changed in potential. As a result, an electrostatic latent image is formed on the peripheral surface of the photosensitive drum 2. In this embodiment, the potential level V1 (light point potential level) to which the potential of a given point of the peripheral surface of the photosensitive drum 2 changes as it is exposed to the beam of laser light L is −100 V (V1=−100 V).

Next, in the development step, the electrostatic latent image formed on the peripheral surface of the photosensitive drum 2 is developed by the developing apparatus 4 into a visible image, that is, an image formed of developer (toner). More specifically, the developing apparatus comprises a development roller 42 as a developer bearing member, which is rotationally driven in the direction indicated by an arrow mark B, and on which toner 41 as developer is borne to be conveyed. As the development voltage (development bias) is applied from an unshown high voltage power source for development, the toner 41 on the peripheral surface of the development roller 42 is transferred onto the numerous points, with the light potential level, of the peripheral surface of the photosensitive drum 2. As a result, a visible image is formed of the toner 41 (developer), on the peripheral surface of the photosensitive drum 2. In this embodiment, the development bias (voltage) Vdc is set to 300 V so that the negatively charged toner 41 is adhered to the exposed points of the peripheral surface of the photosensitive drum 2 to form a visible image of the toner, on the peripheral surface of the photosensitive drum 2; the electrostatic latent image is reversely developed.

While an image is formed on the peripheral surface of the photosensitive drum 2, the transfer medium 7 as an image receiving member stored in the cassette 71 is delivered by a feed roller 72 to a registration roller 73, in synchronism with the formation of a latent image on the photosensitive drum 2. Then, the transfer medium 7 is conveyed to the transfer charging device (transfer roller) as a transferring means, in synchronism with the arrival of the leading edge of the toner image on the photosensitive drum 2 at the transfer charging device 6. Then, as the transfer medium 7 is moved between the photosensitive drum 2 and transfer charging device 6, the toner image on the photosensitive drum 2 is transferred onto the transfer medium 7. In this embodiment, the voltage Vtr as transfer bias applied to the transfer roller 6 from an unshown high voltage power source for transfer is 1,000 V (Vtr=1,000 V).

After the transfer of the toner image onto the transfer medium 7, the toner image is permanently fixed (fixation step) to the transfer medium 7 by the fixing device 8. Then, lastly, the transfer medium 7 is discharged from the main assembly of the image forming apparatus.

As for the developer (toner) which remained on the peripheral surface of the photosensitive drum 2, it is removed by the cleaning apparatus 5, which employs a cleaning member (cleaning blade) 51, that is, an elastic blade. The cleaning blade 51 is angled so that the edge of its elastic blade placed in contact with the peripheral surface of the photosensitive drum 2 is on the upstream side, in terms of the rotational direction of the drum 2, relative to the portion of its elastic blade by which the cleaning blade is attached to its support.

Figure 2:
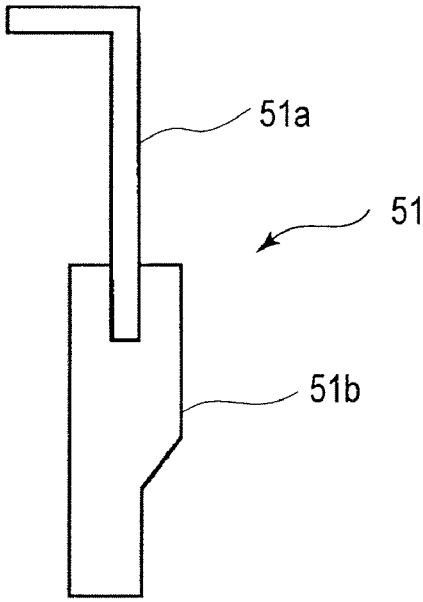
FIG. 2 is a schematic drawing of an example of the cleaning member in accordance with the present invention, showing the general structure thereof.

FIG. 2 is a sectional view of the cleaning blade 51 used in this embodiment. The cleaning blade 51 comprises: a holder 51*a* formed of a piece of metallic plate; and an elastic blade 51*b* formed of rubbery material such as urethane rubber and bonded to the holder 51*b*. As the material for the elastic blade 51*b*, silicone rubber, nitrile rubber, chloroprene rubber, or the like, may be used, in addition to the urethane rubber used in this embodiment.

As for the countermeasure against the problem attributable to the toner deterioration which occurs in the developing apparatus 4 of the image forming apparatus in this embodiment as the developer in the developing apparatus 4 is used for a substantial length of time, the deteriorated toner in the developing apparatus 4 is consumed by being forced to transfer onto the image-free portion of the peripheral surface of the photosensitive drum 2, that is, portion of the peripheral surface of the photosensitive drum 2, across which no image is formed. In other words, the image forming apparatus is provided with a developer transfer controlling means for initializing the body of toner in the developing apparatus by expelling the deteriorated toner in the developing apparatus 4. In this embodiment, however, the image forming apparatus is equipped with the cleaning blade 51 in accordance with the prior art, which due to its structure, may possibly fail to satisfactorily clean the photosensitive drum 2.

Thus, in this embodiment, the amount by which the deteriorated toner is forced to transfer onto the photosensitive drum 2 is varied in response to the changes in the internal ambience of the image forming apparatus so that the cleaning performance of the cleaning blade 51 is maintained at a satisfactory level without negatively affecting the developmental performance of the image forming apparatus.

More specifically, the image forming apparatus in this embodiment is provided with an ambient condition detecting means 12 (which hereinafter may be referred to as ambience detection sensor or ambience sensor), which is disposed within the image forming apparatus in order to measure the internal temperature and/or humidity of the image forming apparatus. In this embodiment, the ambience detection sensor 12 is placed in the adjacencies of the cleaning apparatus 5.

Also in this embodiment, the photosensitive drum 2, charge roller 3, developing apparatus 4, and cleaning apparatus 5 are integrated in the form of a process cartridge 10; these components are disposed in the cartridge 10 so that the predetermined positional relationships are maintained among them. The cartridge 10 and image forming apparatus are structured so that the cartridge 10 can be mounted into the cartridge compartment of the main assembly of the image forming apparatus, or removed therefrom, through predetermined steps, improving thereby the image forming apparatus in terms of maintainability.

At this time, the control of the image forming apparatus, which characterizes this embodiment of the present invention, will be described. According to this control, the deteriorated toner in the developing apparatus 4 is consumed by forcing the deteriorated toner to transfer onto the image-free portion of the peripheral surface of the photosensitive drum 2, so that the developing apparatus 4 will be supplied with a fresh supply of developer. Here, the image-free portion of the peripheral surface of the photosensitive drum 2 means the portion of the peripheral surface of the photosensitive drum 2, across which no toner image is formed in accordance with a given set of image formation data. In other words, it is the portion of the peripheral surface of the photosensitive drum 2, to which toner is not adhered in accordance with the given set of image formation data. Thus, it is the non-transfer portion of the peripheral surface of the photosensitive drum 2, that is, the portion of the peripheral surface of the photosensitive drum 2, which does not come into contact with the transfer medium as a medium which receives a toner image from the photosensitive drum 2. Therefore, as toner is transferred onto this portion of the photosensitive drum 2 from the developing apparatus 4, it is not transferred onto the transfer medium, and is conveyed, as it is, to the cleaning station in which the peripheral surface of the photosensitive drum 2 is cleaned by the cleaning member. Unlike the toner on the image forming portion of the peripheral surface of the photosensitive drum 2, the toner on the image-free portion of the peripheral surface of the photosensitive drum 2 is not transferred. Therefore, the image-free portion is substantially greater in the amount of the toner thereon per unit area than the image forming portion.

Figure 3:
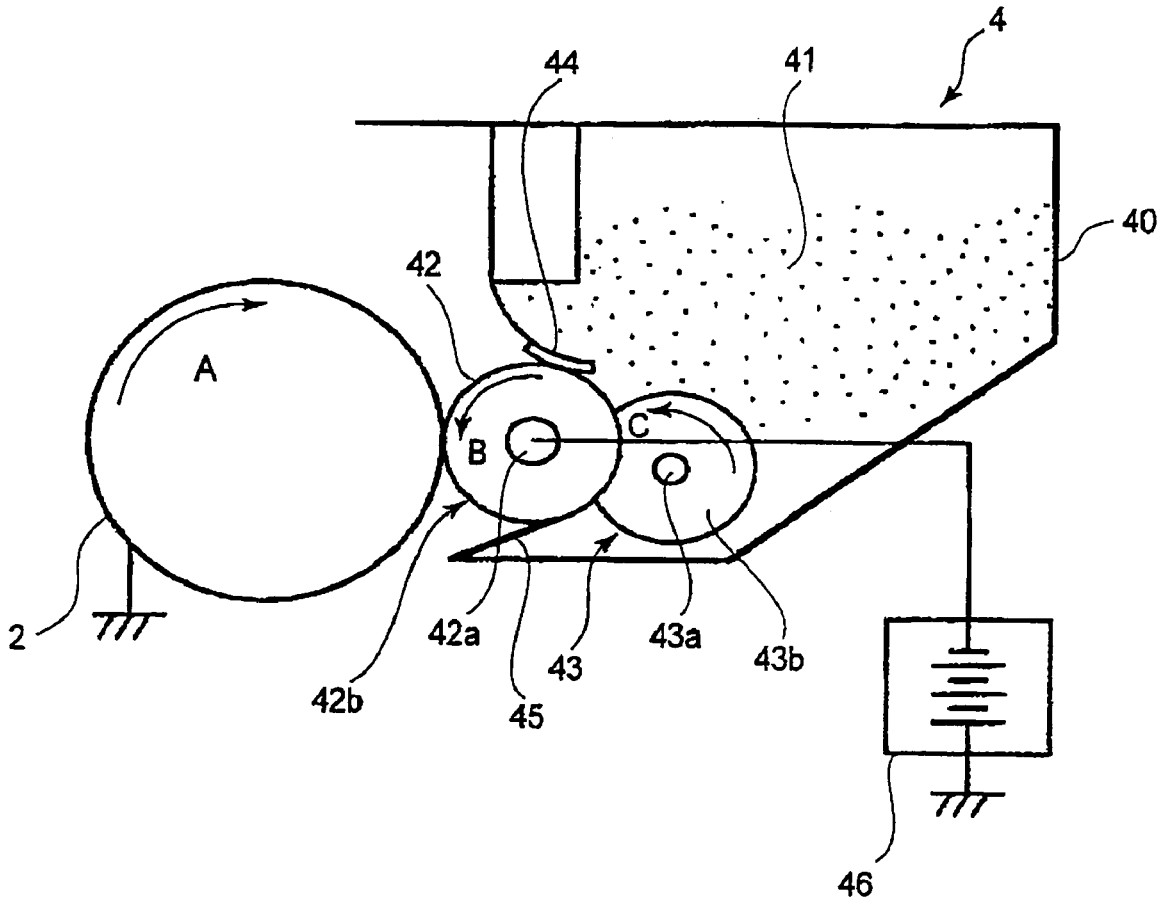
FIG. 3 is a schematic drawing of an example of the developing apparatus in accordance with the present invention, showing the general structure thereof.

Next, referring to FIG. 3, the developing apparatus 4 in this embodiment will be described. FIG. 3 is a schematic sectional drawing of the developing apparatus 4 in this embodiment. The developing apparatus 4 in this embodiment comprises: the toner container 40; the developer 41 (toner) stored in the toner container 40; development roller 42 which bears the toner 41 on its peripheral surface, and conveys the toner 41 to the development area which the photosensitive drum 2 and development roller 42 form; toner supply roller 43 as a developer supplying member which conveys the toner 41 to the development roller 42 and coats the development roller 42 with the toner 41; development blade 44 as a member which controls the thickness in which the toner 41 is laid, in order to assure that the toner 41 is delivered to the development area by a proper amount per unit area of the peripheral surface of the development roller 42; blowout prevention sheet 45 disposed downstream of the development area in terms of the rotational direction of the development roller 42, in contact with the peripheral surface of the development roller 42 in order to prevent the toner 41 from leaking from the developing apparatus 4; and a high voltage power source 46 disposed in the main assembly of the image forming apparatus and connected to the development roller 42 to carry out the development step, in the development area.

The development roller 42 comprises: a cylindrical member 42*a*, as a substrate, formed of metallic substance such as aluminum, aluminum alloy, stainless steel, or the like, and an elastic layer 42*b* which thoroughly covers the peripheral surface of the cylindrical member 42*a* as a substrate. The external diameter of the development roller 42 in this embodiment is 16 mm. The elastic layer 42*b* has a base layer formed of such rubber as silicone rubber, polyurethane rubber, NBR, or the like, and a surface layer formed of ether-urethane, Nylon, or the like. The materials for the development roller 42 do not need to be limited to the above described ones. For example, a foamed material such as sponge may be used as the material for the base layer, whereas the surface layer may be formed of rubbery material. The development roller 42 in this embodiment has the elastic layer 42*b* formed of polyurethane, and is rotationally driven in the direction indicated by an arrow mark B at a peripheral velocity of 141 mm/sec.

The development blade 44 is made up of a piece of thin elastic metallic plate, more specifically, a piece of 0.1 mm thick phosphor bronze, and a 1 mm thick elastic member formed of polyamide elastomer attached to the phosphor bronze plate by adhesive, or attached to the phosphor bronze plate through a process of injection molding. It is placed in contact with the peripheral surface of the development roller 42 so that a predetermined amount of linear contact pressure is maintained between the surface of the elastic member and the peripheral surface of the development roller 42. It is enabled to maintain the predetermined amount of contact pressure by the resiliency of the abovementioned 0.1 mm thick phosphor bronze plate, while charging the toner 41, the inherent polarity of which is negative, by the polyamide elastomer portion thereof. Thus, as the development roller 42 is rotated with the development blade 44 kept in contact with the peripheral surface of the development roller 42, a toner layer with a predetermined thickness is formed on the peripheral surface of the development roller 42. The development blade 44 in this embodiment is structured and set so that as the body of toner borne on the peripheral surface of the development roller 42 is moved past the development blade 44, the amount of the toner on the peripheral surface of the development roller 42 becomes 0.4 mm/cm$^2$. The material for the thin metallic plate portion of the development blade 44 does not need to be limited to the above described one, as long as the predetermined amount of contact pressure can be maintained between the development blade 44 and development roller 42. Further, the material for the elastic member may be selected in consideration of the inherent polarity and chargeability of the toner 41. For example, when a certain type of development roller is used in combination with a certain type of toner, a plain piece of thin elastic plate, such as thin plate of stainless steel, phosphor bronze, or the like, may be used as the development blade 44 so that the plain piece of thin elastic plate is kept pressed against the peripheral surface of the development roller 42 with the presence of the layer of toner 41 between the plain piece of elastic plate and the peripheral surface of the development roller 42.

As the toner supply roller 43, a roller formed of sponge, a roller comprising a metallic core, and pile of rayon fiber, nylon fiber, or the like planted on the peripheral surface of the metallic core, is preferable, in consideration of such factors as the efficiency with which the toner 41 is conveyed to the development roller 42, the efficiency with which the development roller 42 is coated with the toner 41 by the toner supply roller 43, and the efficiency with which the toner remaining on the peripheral surface of the development roller 42 after the latent image development is stripped away from the development roller 42. The toner supply roller 43 in this embodiment comprises a metallic core 43*a*, and a layer 43*b* of urethane foam covering the peripheral surface of the metallic core 43*a*. It is 16 mm in diameter. It is rotationally driven in the same direction (indicated by arrow mark C) as the development roller 42, at a peripheral velocity of 113 mm/sec, in synchronism with the development roller 42; it is rotated or stopped at the same time as the development roller 42 is rotated. In this embodiment, the amount of the apparent invasion of the toner supply roller 43 into the development roller 42 is 1.5 mm.

Figure 4:
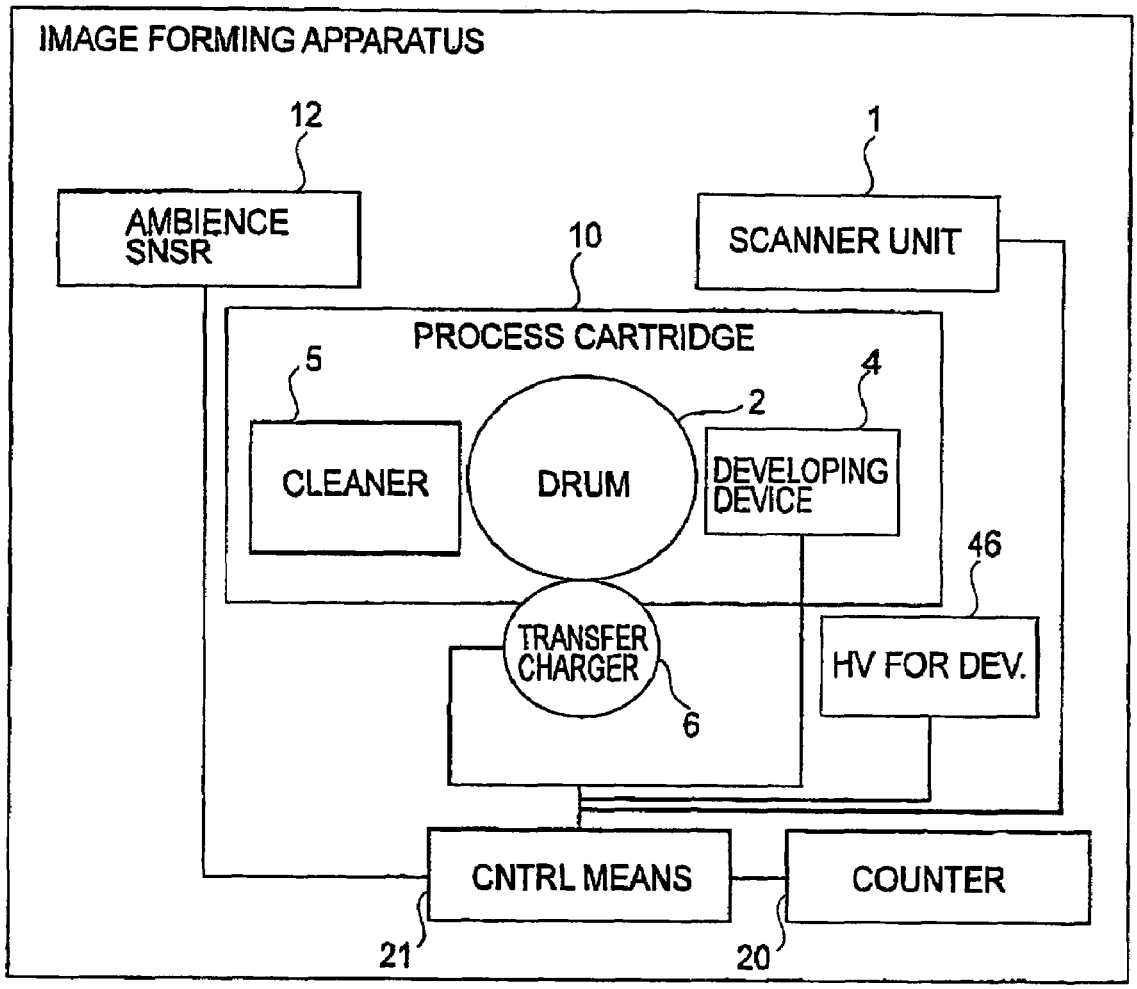
FIG. 4 is a block chart of an example of the developer transfer controlling means in accordance with the present invention.

Next, referring to FIG. 4, which is a diagram showing the relationship among the various components of the image forming apparatus, the structure with which the image forming apparatus is provided to force the deteriorated toner in the developing apparatus 4 to transfer onto the photosensitive drum in order to initialize the toner in the developing apparatus 4, will be described.

The developer transfer control for transferring the toner 41 from the developing apparatus 4 onto the photosensitive drum 2 with a predetermined timing when the image forming apparatus is not actually forming an image, is primarily carried out by a controlling means 21 of the image forming apparatus which controls the entire operation of the image forming apparatus. The controlling means 21 is connected to the scanner unit 1, developing apparatus 4, transferring charging device 6, etc., and controls the process of forming an image on the transfer medium 7, based on the image formation data inputted from the unshown host computer, or the like.

Hereinafter, the mode in which the ordinary image formation process which comprises the above described charging step, latent image forming step, developing step, transferring step, and fixing step, is carried out for forming an ordinary image desired by a user, will be referred to as "normal image formation mode".

To the controlling means 21, a transfer medium counter 20 is connected, which is for counting the number of the copies made by the image forming apparatus, that is, how many times the image forming process is carried out by the image forming apparatus. In other words, the counter 20 is a device for counting the number of transfer mediums 7 onto which an image is formed in the normal image formation mode. The controlling means 21 reads the value in the counter 20, and as the number of the transfer mediums 7 onto which an image was formed in the normal image formation mode reaches a predetermined value, the controlling means 21 causes the image forming apparatus to carry out the operation for forcing the toner to transfer from the developing apparatus 4 onto the image-free portion of the peripheral surface of the photosensitive drum 2. This mode in which the toner is forced to transfer from the developing apparatus 4 onto the image-free portion of the peripheral surface of the photosensitive drum 2 will be referred to as "forced transfer mode".

In this embodiment, the image forming apparatus is operated in the forced transfer mode for every 100$^{th}$ transfer medium 7, and each time the image forming apparatus is operated in the forced transfer mode, the counter 20 is reset to start cumulatively counting again the number of times images are formed in the normal image formation mode.

To describe more concretely the operation carried out by the image forming apparatus when the apparatus is in the forced transfer mode, first, the controlling means 21 temporarily interrupts the normal image formation mode, stopping thereby the conveyance of the transfer medium 7. In other words, the controlling means 21 temporarily interrupts the normal image forming operation, and operates the image forming apparatus in a mode, in which no ordinary image is formed, and the scanner unit 1 is caused to scan the peripheral surface of the photosensitive drum 2 across the entire range of the peripheral surface of the photosensitive drum 2 in terms of the primary scanning direction, and also, by a predetermined width in terms of the secondary scanning direction, in order to form a latent image different the latent image formed in accordance with the image formation data inputted from the host computer or the like.

Incidentally, regarding the direction in which the beam of light from the scanning unit 1 is made to oscillate, the direction intersectional to the direction in which the transfer medium 7 is conveyed is referred to as the primary scanning direction, and the direction in which the peripheral surfaces of the photosensitive drum 2 and transfer charging device 6 move is referred to as the secondary scanning direction.

Next, the development bias is applied to the developing apparatus 4 in order to transfer the toner 41 in the developing apparatus 4 onto the peripheral surface of the photosensitive drum 2, on which the latent image different from the latent image formed in accordance with the image formation data inputted from the host computer or the like is present. As a result, the toner in the developing apparatus 4 is initialized. More specifically, in this embodiment, one of the reversal developing methods is employed. Therefore, the toner is expelled from the developing apparatus 4 onto the points of the peripheral surface of the photosensitive drum 2, which have just been exposed by the scanner 1 as an exposing apparatus.

Next, the toner 41 which was force to transfer onto the photosensitive drum 2 is recovered by the cleaning apparatus 5 as the photosensitive drum 2 is rotated. In this forced transfer mode, however, the toner 41 (toner image) on the peripheral surface of the photosensitive drum 2 is moved past the transfer roller 6 as a transfer charging device, with the absence of the transfer medium 7 between the toner 41 and transfer roller 6. Therefore, the toner 41 on the peripheral surface of the photosensitive drum 2 comes into contact with the peripheral surface of the transfer roller 6. Thus, during the forced transfer mode, the transfer bias (voltage Vtr) is set to zero (Vtr=0), in order to prevent the transfer roller 6 from being soiled. The above described process is carried out once every $100^{th}$ copy. This is the forced transfer mode.

In this embodiment, the width by which the peripheral surface of the photosensitive drum 2 is scanned by the scanner unit 1 in the primary scanning direction in order to form a latent image in the forced transfer mode is set to 216 mm. The width by which the peripheral surface of the photosensitive drum 2 is exposed by the scanner unit 1 in terms of the secondary scanning direction in the forced transfer mode is desired to be no less than the circumference of the development roller 42 or toner supply roller 43. In this embodiment, the circumferences of the development roller 42 and toner supply roller 43 are 33.4 mm and 41.8 mm, respectively. Thus, in this embodiment, the width by which the peripheral surface of the photosensitive drum 2 is exposed in terms of the secondary scanning direction is set to be no less than 41.8 mm, which is greater than the circumference of the development roller 42. Therefore, the toner on the peripheral surface of the development roller 42 and the toner on the peripheral surface of the toner supply roller 43 are simultaneously forced to transfer onto the peripheral surface of the photosensitive drum 2.

As for the length of time the peripheral surface of the photosensitive drum 2 is to be exposed in the forced transfer mode, it is desired to be no less than the time it takes for the development roller 42 or toner supply roller 43 to make one full rotation. In other words, the width, in terms of the rotational direction of the photosensitive drum 2, by which the peripheral surface of the photosensitive drum 2 is to be exposed, has only to be set so that the toner is continuously transferred from the development roller 42 onto the photosensitive drum 2 for no less than the time it takes for the development roller 42 or toner supply roller 43 to make one full rotation.

Also in this embodiment, to the controlling means 21, the ambient condition detection sensor 12 is connected to detect the internal conditions of the image forming apparatus. The ambient condition detection sensor 12 in this embodiment is disposed in the adjacencies of the cleaning apparatus 5. As described above, it detects the internal temperature of the image forming apparatus, and the controlling means 12 continuously determines whether or not the internal temperature of the image forming apparatus is higher than a predetermined value. The image forming apparatus in this embodiment is structured so that when the internal temperature of the image forming apparatus is no more than the predetermined value, the image forming apparatus is prevented from being operated in the forced transfer mode for every $100^{th}$ copy. In other words, the image forming apparatus in this embodiment is designed so that when the internal temperature of the apparatus is no more than the predetermined value, the developer cannot be forced to transfer from the developing apparatus onto the image-free area on the peripheral surface of the photosensitive drum 2.

To describe in more detail, first, the ambience detection sensor 12 determines whether the internal temperature of the image forming apparatus is higher (first ambience) than a predetermined value, or no more (second ambience) than the predetermined value.

More concretely, a temperature of 10° C., below which the cleaning blade 51 reduces in resiliency, is used as the threshold value for determining whether the internal ambience of the image forming apparatus is the first ambience or the second ambience. That is, the image forming apparatus is designed so that when the internal temperature of the image forming apparatus is no more than 10° C., the image forming apparatus is prevented from being operated in the forced transfer mode; the toner 41 is not forced to transfer from the developing apparatus 4 onto the photosensitive drum 2, for the following reason.

That is, the toner to be recovered into the cleaning apparatus 5 in the normal image formation mode is the transfer residual toner, being therefore relatively small in the amount by which toner is recovered per unit area of the peripheral surface of the photosensitive drum 2. In comparison, the toner to be recovered into the cleaning apparatus 5 in the forced transfer mode does not go through the transfer step, being therefore substantially greater, in terms of the amount by which toner is recovered into the cleaning apparatus 5, than the transfer residual toner, that is, the toner to be recovered in the normal image formation mode. Therefore, in order to prevent the increase in the frequency at which the peripheral surface of the photosensitive drum 2 is unsatisfactorily cleaned by the cleaning blade 51, the image forming apparatus is designed so that when its internal ambience is the low temperature ambience in which the cleaning blade 51 reduces in resiliency, it cannot be operated in the forced transfer mode.

Figure 5:
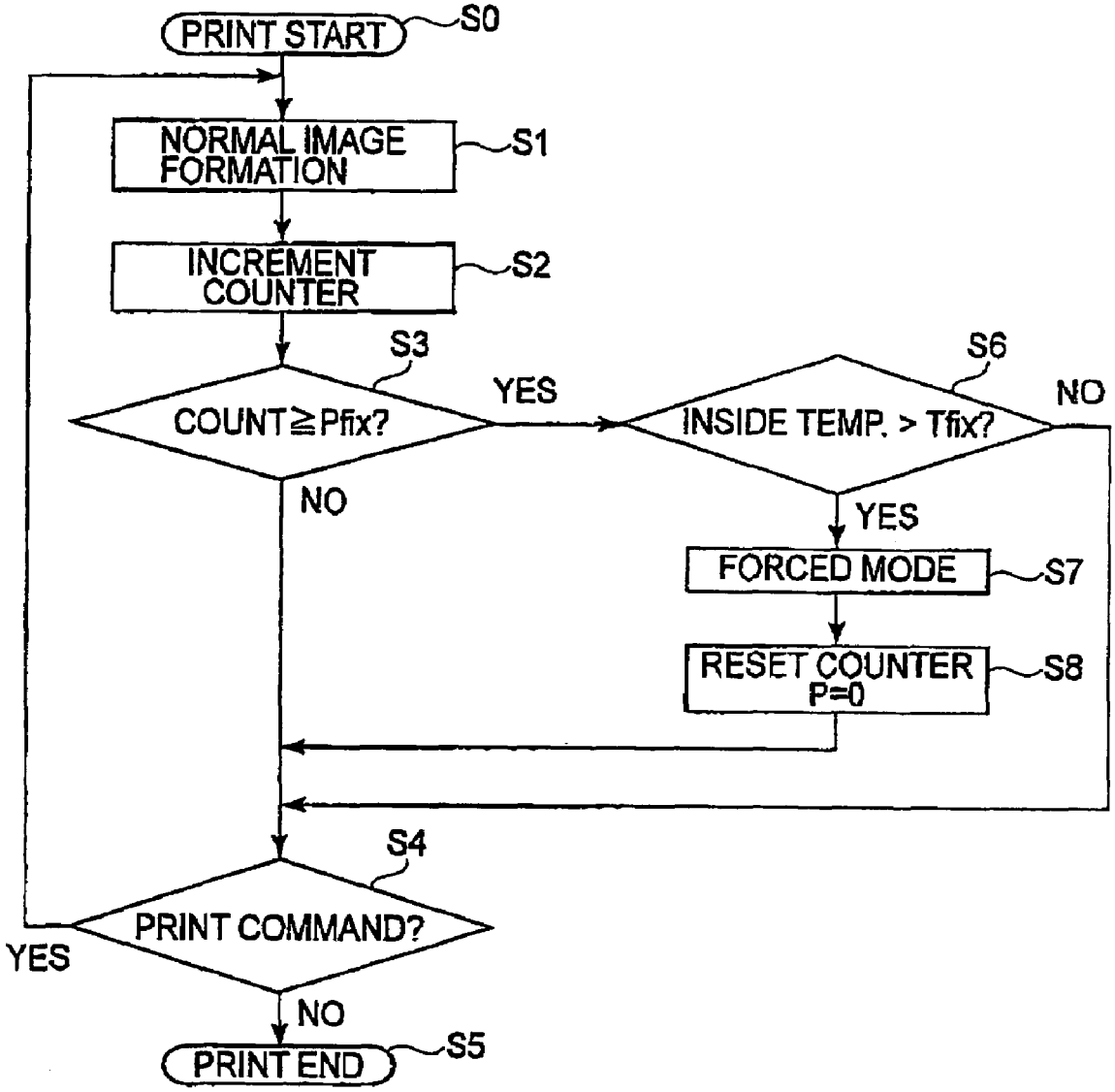
FIG. 5 is a flowchart of an example of the developer transfer controlling process in accordance with the present invention.

FIG. 5 is the flowchart of the forced transfer mode in this embodiment, which will be described next.

As a printing operation is started (S0), the image forming apparatus is operated in the normal image formation mode (S1), and one is added to the value P in the transfer medium counter 20 (S2).

Then, the controlling means 21 determines whether or not the value P in the counter 20 is greater than the predetermined value Pfix (S3). When the value P in the counter 20 is no more than Pfix, the controlling means 21 determines whether there is a print demand or not (S4). When there is a print demand, the image forming apparatus is operated in the normal image formation mode (S1). In this embodiment, the predetermined value Pfix is 100 (Pfix=100). When there is no print demand, the printing operation is ended (S5).

When the controlling means 21 determines that the value P in the counter 20 is greater than the predetermined value Pfix, which in this embodiment is 100 (S3), the controlling means 21 determines whether the internal temperature T of the image forming apparatus detected by the ambience detection sensor 12 is higher than Tfix (S6). In this embodiment, Tfix is 10° C.

When the internal temperature T detected by the ambience detection sensor 12 is higher than the predetermined value Tfix, the image forming apparatus is operated in the above described forced transfer mode (S7), and the counter 20 is reset; the value P is changed to zero (P=0) (S8).

Next, it is determined whether there is a print demand or not (S4). When there is a print demand, the image forming apparatus is operated in the normal image formation mode (S1).

When the internal temperature T detected by the ambience detection sensor 12 is no more than the predetermined value Tfix, whether or not there is a print demand is determined (S4) without operating the image forming apparatus in the forced transfer mode.

When it is determined in Step S6 that the internal temperature T is no more than the predetermined value Tfix, the image forming apparatus is not operated in the forced transfer mode. However, even when the internal temperature T is no more than the predetermined value Tfix, the value P in the counter 20 is increased by one each time an image is formed in the normal image formation mode.

As described above, the image forming apparatus in this embodiment is structured so that it is operated in the forced transfer mode only when the value in the counter 20 is no less than the predetermined value Pfix and the internal temperature of the image forming apparatus is higher than the predetermined value Tfix.

In other words, when the internal temperature of the image forming apparatus detected by the ambience detection sensor 12 is higher than the predetermined value, the image forming apparatus is operated in the forced transfer mode for every $100^{th}$ copy, whereas when it is lower than the predetermined value, the image forming apparatus is not operated in the forced transfer mode even after the value in the counter 20 reaches 100. Therefore, when the cleaning blade 51 is low in resiliency because of the low internal temperature, the image forming apparatus is not operated in the forced transfer mode, and therefore, the unsatisfactory cleaning of the photosensitive drum 2, which is attributable to the large amount of the toner adhered to the peripheral surface of the photosensitive drum 2 when the image forming apparatus is operated in the forced transfer mode, does not occur.

In an experiment in which the image forming apparatus in this embodiment was used several days during the winter, outputting roughly 5,000 copies, in an office in which temperature varied in the range of 5° C.-20° C., not only did the unsatisfactory cleaning of the photosensitive drum 2 not occur even once, but also, images of good quality, that is, images satisfactory in that they did not suffer from such problems as the low density and/or fog, were continuously formed.

As described above, in this embodiment, (1) when the internal temperature of the image forming apparatus is higher than the predetermined value (first ambience), the amount by which toner is forced to transfer onto the photosensitive drum while no image is formed is made equal to the amount by which toner is borne on the developer bearing member or developer supplying member per rotation thereof, and (2) when the internal temperature of the image forming apparatus is lower than the predetermined value (second ambience), the process for transferring the deteriorated toner onto the photosensitive drum 2 is not carried out. Therefore, not only is it possible to obtain images of good quality, that is, images satisfactory in that they do not suffer from the fog and/or low density attributable to the toner deterioration in the developing apparatus, but also, it is possible to keep the cleaning blade at a satisfactory level in terms of cleaning performance.

In this embodiment, a temperature of 10° C. is selected as the threshold temperature value referenced to determine whether or not the internal temperature of the image forming apparatus is low enough to reduce the cleaning blade 51 in resiliency. In other words, whether or not the image forming apparatus is to be operated in the forced transfer mode is determined with reference to this referential value of 10° C. This threshold temperature value Tfix may be changed as necessary in accordance with the properties of the cleaning blade.

Also in this embodiment, the image forming apparatus is designed so that it is operated in the forced transfer mode after the outputting of every $100^{th}$ copy. However, the predetermined value Pfix does not need to be 100. For example, it may be changed as necessary in accordance with the developing apparatus structure and durability of the toner. Further, the image forming apparatus may be designed so that it cumulatively measures the length of time its developing apparatus is operated in the normal image formation mode, and will be operated in the forced transfer mode as the cumulative length of time the developing apparatus is operated in the normal image formation mode reaches a predetermined value.

Also in this embodiment, the width, in terms of the secondary scanning direction, by which the peripheral surface of the photosensitive drum 2 is exposed by the scanner unit 1 while the image forming apparatus is operated in the forced transfer mode, was set to the value equal to to the circumference of the toner supply roller 43. However, this width is optional; it may be changed as necessary in accordance with the diameter and peripheral velocity of the development roller 42, or the diameter and peripheral velocity of the toner supply roller 43. In any case, as long a's the amount by which toner is forced to transfer from the developing apparatus onto the photosensitive drum 2 is made greater than the amount by which toner is borne on the development roller, developer supply roller, or the like member, per full rotation thereof, the object of initializing the developing apparatus is accomplished, and therefore, images of good quality, like the images formed by the image forming apparatus in this embodiment, that is, images satisfactory in that they do not suffer from the fog and low density, are continuously outputted.

Incidentally, as described above, the thickness in which a toner layer is formed on the peripheral surface of the development roller 42 is regulated by the development blade 44, being therefore constant. Therefore, the amount by which toner is borne on the peripheral surface of the development roller 42 as the development roller 42 is rotated one full turn remains constant. Therefore, in this specification, the amount by which toner is forced to transfer onto the photosensitive drum 2 while the image forming apparatus is operated in the forced transfer mode is regulated by the circumference of the development roller 42, or the circumference of the toner supply roller 43 which rotates with the development roller 42.

Embodiment 2

In the first embodiment, the image forming apparatus was designed so that when it is operated in a low temperature environment, that is, when its internal temperature is no more than the predetermined value, it is prevented from being operated in the forced transfer mode. In comparison, this embodiment is characterized in that the image forming apparatus is designed so that when its internal temperature is no more than a predetermined value, it is operated in two different forced transfer modes: the forced transfer mode for low temperature, in which it is operated when the internal temperature is no more than a predetermined value, and the forced transfer mode for low humidity, in which it is operated when its internal humidity is no more than a predetermined value.

In terms of the basic structure, the image forming apparatus and process cartridges in this embodiment are the same as those in the first embodiment. Therefore, the components of the image forming apparatus in this embodiment, which are the same as those in the first embodiments, are given the same referential symbols as those given in the first embodiment, and will not be described in detail.

The cleaning apparatus 5 is an apparatus for recovering the toner 41 on the peripheral surface of the photosensitive drum 2. It has been known that the toner property related to electrical charge is affected by the ambient humidity. The toner used by the developing apparatus in this embodiment is frictionally charged primarily as it is rubbed while the toner is moved past the development blade 44 by the rotation of the development roller 42. The amount by which the toner is given triboelectric charge is greatly affected by the ambient humidity. More specifically, when the ambient humidity is low, not only is the toner given a greater amount of triboelectric charge, but also, the triboelectric charge given to the toner is less likely to discharged into the air, and therefore, the toner remains highly charged for a longer time. Since the greater the toner in the amount of triboelectric charge it holds, the greater the toner in the amount of the coulometric force, being therefore, the greater in the amount of the force by which it is kept adhered to the photosensitive drum 2. Therefore, when the ambient humidity is low, the toner sometimes moves past the cleaning blade 51, although only by a small amount.

In other words, when the ambient humidity is low, the photosensitive drum 2 is sometimes unsatisfactorily cleaned, because a small amount of the toner moves past the cleaning blade 51.

Therefore, in this embodiment, the image forming apparatus is controlled so that even when its internal temperature is no more than the predetermined value, it is not prevented from operating in the forced transfer mode, whereas in the first embodiment, the image forming apparatus was controlled so that when its internal temperature was not more than the predetermined value, it is prevented from being operated in the forced transfer mode. More specifically, when the internal temperature of the image forming apparatus is no more than the predetermined value, whether or not the internal humidity of the image forming apparatus is no more than a predetermined value is detected by the ambience detection sensor 12. Then, when the ambient humidity is higher than the predetermined value, the image forming apparatus is operated in the forced transfer mode for $100^{th}$ copy, whereas when the ambient humidity is no more than the predetermined value, the image forming apparatus is operated in the modified version of the forced transfer mode, or the forced transfer mode for low humidity, in which the amount by which toner is forced to transfer from the developing apparatus 4 onto the photosensitive drum 2 is smaller than the amount by which toner is forced to transfer from the developing apparatus 4 onto the photosensitive drum 2, in the forced transfer mode in the first embodiment. Next, the structure of the image forming apparatus in this embodiment will be described with reference to FIGS. 4 and 6.

Here, the forced transfer mode in this embodiment, like the forced transfer mode in the first embodiment, in which the image forming apparatus is operated to expel developer from the developing apparatus 4 for every $100^{th}$ copy when the internal temperature and humidity are not low, is called the first forced transfer mode.

In this embodiment, when the internal ambience of the image forming apparatus is not the low temperature/low humidity ambience (first ambience), that is, the internal temperature detected by the ambience detection sensor 12 is no less than a predetermined value, and the internal humidity detected by the ambience detection sensor 12 is no less than a predetermined value, the controlling means 21 reads the value in the transfer medium counter 20 connected to the controlling means 21, and controls the image forming apparatus so that toner is forced to transfer from the developing apparatus 4 onto the photosensitive drum 2 for every predetermined number, which is the 100 in this embodiment, of copies, and resets the counter 20 to zero to restart cumulatively counting the number of the copies made by the image forming apparatus while the apparatus is operated in the normal image formation mode.

To describe concretely the operation of the image forming apparatus in the first forced transfer mode, first, the controlling means 21 temporarily interrupts the normal image formation mode, stopping thereby the conveyance of the transfer medium 7. In other words, the controlling means 21 temporarily interrupts the normal image forming operation, and operates the image forming apparatus in an operational mode, in which and the peripheral surface of the photosensitive drum 2 is exposed by the scanner unit 1 across the entire primary scanning range of the peripheral surface of the photosensitive drum 2, and by a predetermined width, which in this embodiment is 41.8 mm, in the secondary scanning direction, exposing thereby the peripheral surface of the photosensitive drum 2 by the width of 41.8 mm, forming thereby a latent image different from the latent image formed in accordance with the image formation data inputted from the host computer or the like. Next, a DC voltage of Vdc (=−300 V) as development bias is applied to the developing apparatus 4, causing thereby the toner 41 in the developing apparatus 4 to transfer onto the peripheral surface of the photosensitive drum 2. As a result, the toner in the developing apparatus 4 is initialized. The toner 41 which has transferred onto the photosensitive drum 2 is recovered by the cleaning apparatus 5 as the photosensitive drum 2 is rotated. In other words, whether or not the internal temperature or humidity of the image forming apparatus is no less than the predetermined value is continuously monitored by the ambience detection sensor 12. When the internal ambience of the image forming apparatus is not the low temperature/low humidity ambience, the image forming apparatus is operated in the first forced transfer mode, which is similar to the forced transfer mode in the first embodiment described with reference to FIGS. 4 and 5.

Further, when the internal temperature or humidity of the image forming apparatus is no more than the predetermined value, the image forming apparatus is operated in the forced transfer mode for low temperature, or the forced transfer mode for low humidity, which are the modifications of the first forced transfer mode, for every $100^{th}$ copy.

To describe more concretely the forced transfer mode for low temperature in this embodiment, a temperature of 10° C., below which the cleaning blade 51 reduces in resiliency, is selected as the threshold value referenced to determine whether or not the internal ambience of the image forming apparatus is the low temperature ambience, and when the internal temperature of the image forming apparatus is no more than 10° C., the scanner unit 1 is prevented from exposing the peripheral surface of the photosensitive drum 2, in order to prevent the toner 41 from transferring onto the photosensitive drum 2. The development bias applied in this mode, and the conditions under which the image forming apparatus is operated in this mode, are the same as those in the first forced transfer mode.

The toner recovered by the cleaning apparatus 5 in the forced transfer mode for low temperature is equivalent to the transfer residual toner recovered by the cleaning apparatus 5 in the normal image formation mode, being therefore relatively small in the amount per unit area by which it is recovered. In comparison, the amount by which the toner is recovered by the cleaning apparatus 5 in the forced transfer mode is substantially greater than the amount of the transfer residual toner, because the toner to be recovered by the cleaning apparatus 5 in the forced transfer mode does not go through the transfer step. Therefore, this embodiment can prevent the problem that as the internal temperature of the image forming apparatus decreases below the known temperature level, below which the cleaning blade 51 reduces in resiliency, the frequency with which the unsatisfactory cleaning occurs increases. In the first embodiment, the image forming apparatus was designed so that when its internal temperature was no more than the predetermined level, it is simply prevented from being operated in the forced transfer mode. In comparison, in this embodiment, the image forming apparatus is designed so that when its internal temperature is no more than the predetermined level, it is operated in the forced transfer mode for low temperature, in which the amount by which toner transfers onto the photosensitive drum 2 is virtually zero.

To describe more concretely the forced transfer mode for low humidity, it is such a forced transfer mode in which when the internal humidity of the image forming apparatus is no more than 30% RH (threshold value), below which the cleaning blade 51 increases in the amount of the frictional charge it gives toner, the amount by which toner is forced to transfer onto the photosensitive drum 2 is reduced by reducing the voltage Vdc, as development bias, applied to the development roller 42 when the image forming apparatus is operated in the forced transfer mode for every $100^{th}$ copy. In this embodiment, the voltage Vdc applied in the forced transfer mode for low humidity is −150 V (Vdc=−150 V).

The above described reduction in the voltage Vdc as development bias is made as the countermeasure against the problem that when the internal humidity of the image forming apparatus is lower than a predetermined level, the amount by which toner is given triboelectrical charge is large enough to enable the toner to slip past the cleaning blade 51. In this embodiment, in which one of the reversal developing methods is employed, the voltage Vdc as development bias applied in the first forced transfer mode is set to −300 V (Vdc=−300 V), whereas the voltage Vdc applied in the forced transfer mode for low humidity is set to −150 V (Vdc=−150 V), in order to reduce the amount by toner is transferred onto the photosensitive drum 2, compared to the amount by which toner is transferred onto the photosensitive drum 2 in the first forced transfer mode, by reducing the difference in potential level between the potential level of the development roller 42 and the potential level V1 (=−100 V) of the exposed point of the peripheral surface of the photosensitive drum 2. The factors other than the development bias are the same as those in the first forced transfer mode.

With the employment of the above described controlling method, the frequency with which toner slipped past the cleaning blade 51 in the forced transfer mode for low humidity was substantially low.

When the image forming apparatus is in this mode, the toner 41 moves past the transfer charging device (transfer roller) 6 without the presence of the transfer member 7 between the toner 41 and transfer charging device 6. Therefore, the voltage Vtr as transfer bias is set to 0 V (Vtr=0 V) in order to prevent the contamination of the transfer charging device 6, as it was in the first forced transfer mode.

Figure 6:
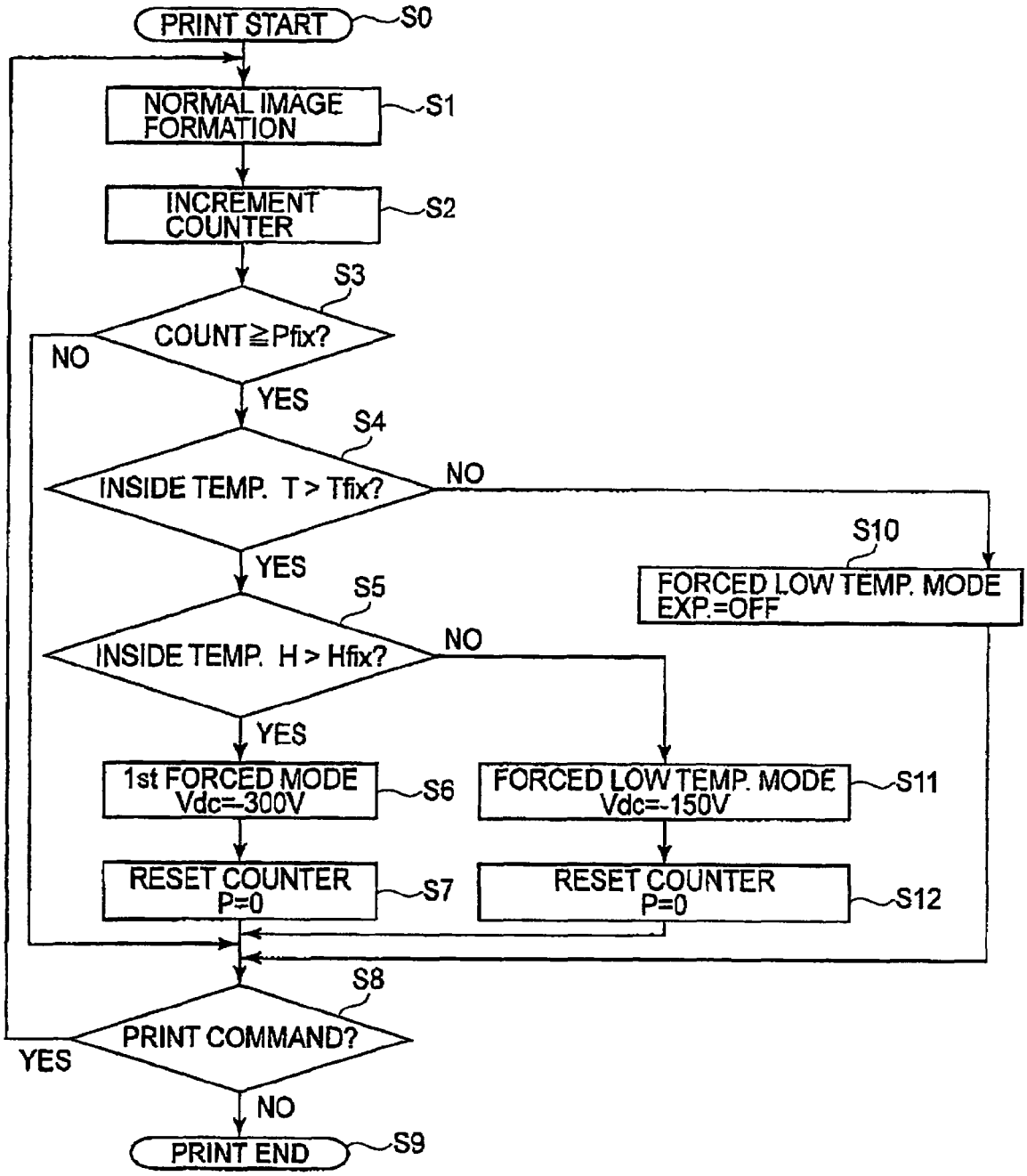
FIG. 6 is a flowchart of another example of the developer transfer controlling process in accordance with the present invention.

Next, referring to FIG. 6, which is a flowchart, the operation of the image forming apparatus in this embodiment will be described.

As a printing operation is started (S0), the image forming apparatus is operated in the normal image formation mode (S1), and one is added to the value P in the transfer medium counter 20 (S2).

Then, the controlling means 21 determines whether or not the value P in the counter 20 is no less than the predetermined value Pfix (S3). When the value P in the counter 20 is less than Pfix, the controlling means 21 determines whether there is a print demand or not (S8). When there is a print demand, the image forming apparatus is operated in the normal image formation mode (S1). In this embodiment, the predetermined value Pfix is 100 (Pfix=100).

When there is no print demand, the printing operation is ended (S9).

When the controlling means 21 determines that the value P in the counter 20 is no less than the predetermined value Pfix, which in this embodiment is 100 (S3), the controlling means 21 determines whether the internal temperature T of the image forming apparatus detected by the ambience detection sensor 12 is higher than Tfix (S4). In this embodiment, Tfix is set to 10° C. (Tfix=10° C.).

When the internal temperature T detected by the ambience detection sensor 12 is higher than the predetermined value Tfix, the controlling means 21 determines whether or not the internal humidity H of the image forming apparatus detected by the ambience detection sensor 12 is higher than a predetermined value Hfix (S5). In this embodiment, the predetermined value Hfx is 30% RH (Hfix=30% RH).

When the internal humidity H of the image forming apparatus detected by the ambience detection sensor 12 is higher than the predetermined value Hfix, the image forming apparatus is operated in the above described first forced transfer mode (S6), and the counter 20 is reset; the value P in the counter 20 is changed to zero (P=0) (S7).

Next, it is determined whether there is a print demand or not (S8). When there is a print demand, the image forming apparatus is operated in the normal image formation mode (S1).

Then, the controlling means 21 determines whether or not the internal temperature T of the image forming apparatus detected by the ambience detection sensor 12 is higher than the predetermined value Tfix (S4). When the internal temperature T of the image forming apparatus is no more than the predetermined value Tfix, the image forming apparatus is operated in the forced transfer mode for low temperature. More concretely, the photosensitive drum 2 is not exposed by the scanner unit 1, and the developing apparatus is driven while a voltage Vdc of 300 V is applied as development bias to the development roller. In other words, the image forming apparatus is operated as if it is in the forced transfer mode; it is operated, with the development voltage set to the value at which toner does not transfer onto the photosensitive drum 2 (S10).

Thereafter, it is determined whether or not there is a print demand, without changing the value P in the counter 20 (S8).

With the above described controlling method, when the internal temperature T of the image forming apparatus is no more than Tfix, the mode in which the image forming apparatus is operated is switched to the forced transfer mode for low temperature. However, toner is not transferred onto the photosensitive drum 2.

As for the value in the counter 20, it is increased by one each time an image is formed by the image forming apparatus in the normal image formation mode, even if the internal temperature T of the apparatus is no more than the predetermined value Tfix.

As described above, when the internal temperature T of the image forming apparatus is higher than the predetermined value Tfix, the image forming apparatus is operated in the first forced transfer mode, and when the internal temperature of the image forming apparatus is no more than predetermined value Tfix, the image forming apparatus is operated in the forced transfer mode for low temperature.

When the controlling means 21 determines that the internal humidity H detected by the ambience detection sensor 12 is no more than the predetermined value Hfix (S5), the operating mode of the image forming apparatus is switched to the forced transfer mode for low humidity. More concretely, the development bias voltage Vdc is switched to −150 V (Vdc=−150 V) to reduce the amount by which toner is forced to transfer onto the photosensitive drum 2 (S11). Thereafter, the counter 20 is reset; the value P in the counter 20 is set to zero (P=0) (S12). Then, it is determined whether there is a print demand (S8), and when there is a print demand, the image forming apparatus is operated in the normal image formation mode (S1).

In an experiment in which the image forming apparatus in this embodiment was used several days during the winter, outputting roughly 5,000 copies, in an office in which temperature and humidity varied in the range of 5° C.-20° C., and 20% RH-50% RH, not only did the unsatisfactory cleaning of the photosensitive drum 2 not occur even once, but also, satisfactory images, that is, images satisfactory in that they did not suffer from such problems as the low density and/or fog, were continuously formed.

As described above, in this embodiment, (1) when the internal temperature or humidity of the image forming apparatus is higher than the predetermined value (first ambience), the image forming apparatus is operated in the first forced transfer mode, in which toner is forced to transfer onto the photosensitive drum 2 for every predetermined number copies by the amount equal to the amount by which toner is transferred onto the photosensitive drum 2 per full rotation of the developer bearing member or developer supply member; (2) when the internal temperature of the image forming apparatus is no more than the predetermined value (second ambience), the image forming apparatus is operated in the forced transfer mode for low temperature, in which toner is forced to transfer by a smaller amount, or not forced to transfer at all; and (3) when the internal humidity of the image forming apparatus is no more than the predetermined value (second ambience), the image forming apparatus is operated in the forced transfer mode for low humidity, which is similar to the forced transfer mode for low temperature, and in which toner is forced to transfer by a smaller amount. Therefore, not only are images of good quality, that is, images satisfactory in that they do not suffer from the fog and/or low density attributable to the toner deterioration in the developing apparatus continuously formed, but also, the cleaning performance of the cleaning blade is always kept at a satisfactorily level.

Further, the image forming apparatus is structured so that the first forced transfer mode, forced transfer mode for low temperature, or forced transfer mode for low humidity are the same in terms of the mechanical operation, and are different only in terms of whether or not the photosensitive drum is exposed by the scanner unit 1, and the setting of the development bias voltage. Therefore, the amount of the data for controlling the image formation sequence for the image forming apparatus is substantially smaller. Therefore, not only does this embodiment contribute to the reduction in the capacity of the controller IC, but also, has the merit of cost reduction.

The threshold values for the temperature and humidity in this embodiment do not need to be limited to the above-mentioned ones. They may be adjusted as necessary.

Further, it may be the development bias that is changed in the forced transfer mode for low temperature. Further, the exposing apparatus may be inactivated when in the forced transfer mode for low humidity. Instead, the exposing apparatus may be inactivated when in the forced transfer mode for low temperature, and the development bias may be changed when in the forced transfer mode for low temperature. In other words, what kind of modification is made to operate the image forming apparatus in the forced transfer mode for low temperature or the forced transfer mode for low humidity is optional, as long as the modification can make the amount by which toner is transferred onto the photosensitive drum 2 in the forced transfer mode for low temperature and forced transfer mode for low humidity smaller than that in the first forced transfer mode.

Embodiment 3

This embodiment is characterized in that it realizes the effects of the above described second embodiment, with the provision of another arrangement.

The members, components, portions, etc., of the image forming apparatus in this embodiment, which are identical to those in the first and second embodiments, will be given the same referential symbols as those given in the first and second embodiments, and will not be described in detail.

Figure 7:
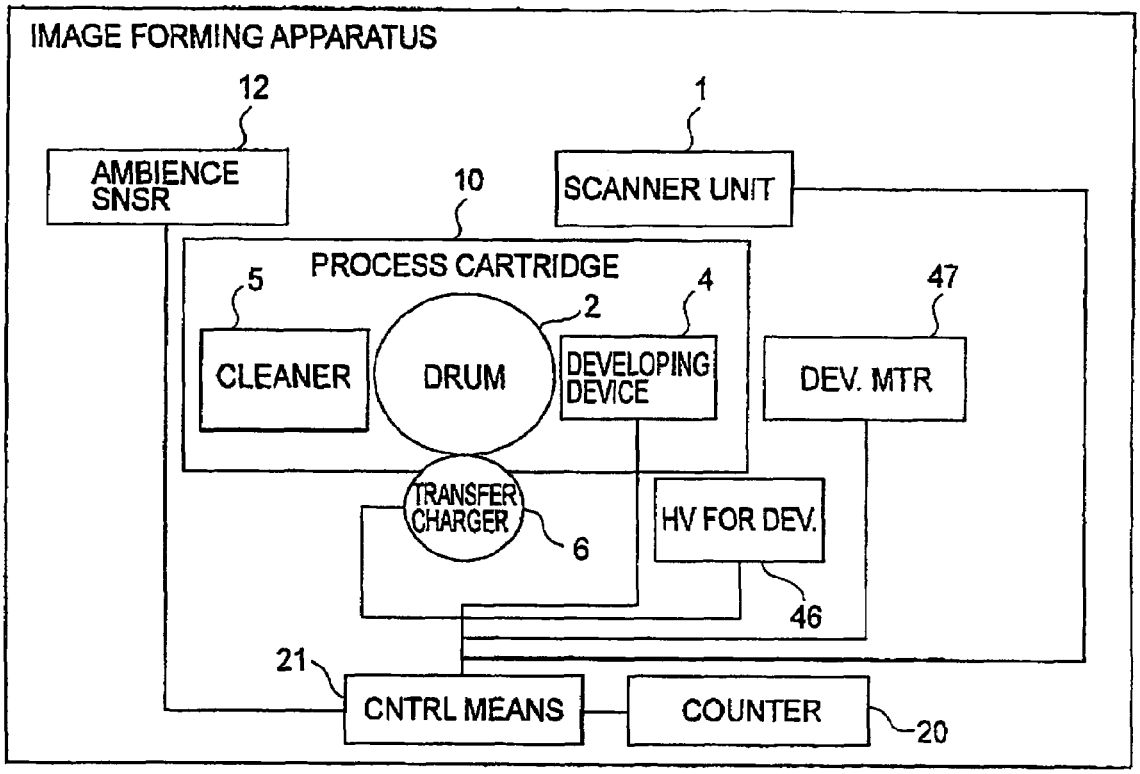
FIG. 7 is a block diagram of another example of the developer transfer controlling means in accordance with the present invention.

Next, referring to FIGS. 7 and 8, the structure of the image forming apparatus in this embodiment will be described.

In this embodiment, when the temperature or humidity detected by the ambience detection sensor 12 is no more than 10° C. or 30% RH, respectively, the operational mode of the image forming apparatus is switched from the first forced transfer mode to the forced transfer mode for low temperature, or forced transfer mode for low humidity, in which the photosensitive drum 2 is not exposed, or the development bias is different from the development bias applied in the first forced transfer mode, as in the second embodiment.

More specifically, the controlling means 21 detects the internal ambient condition of the image forming apparatus through the ambience detection sensor 12 connected to the controlling means 21. In this embodiment, the ambience detection sensor 12 detects the internal temperature and humidity of the image forming apparatus, and the controlling means 21 continuously monitors whether or not the internal temperature or humidity of the image forming apparatus is higher than the predetermined value. When it is no more than the predetermined value, the image forming apparatus is operated in the forced transfer modes different from those in the second embodiment, for every $100^{th}$ copy.

More concretely, when the internal temperature of the image forming apparatus is no more than 10° C. (threshold value) below which the cleaning blade 51 reduces in resiliency, the image forming apparatus is operated in another type forced transfer mode for low temperature, for every $100^{th}$ copy, in which in order to prevent the toner 41 from transferring onto the photosensitive drum 2, the scanner unit 1 is inactivated to prevent the photosensitive drum 2 from being exposed, even if it becomes the time for the forced transfer mode, that is, even if the value in the counter 20 reaches the predetermined number, which is 100 in this embodiment. Referring to FIG. 7, this embodiment is characterized in that the controlling means 21 is connected to the development motor 47 as a development roller driving means, and prevents the development motor 47 for driving the developing apparatus 4 from being driven when the image forcing apparatus is in this forced transfer mode for low temperature. In other words, in this embodiment, when the image forming apparatus is in the forced transfer mode for low temperature, no toner is transferred onto the photosensitive drum 2, and further, the developing apparatus 4 is not driven, preventing thereby the toner deterioration.

In other words, the forced transfer mode for low temperature in the second embodiment is different from the first forced transfer mode only in that the photosensitive drum 2 is not exposed. In comparison, the forced transfer mode for low temperature in this embodiment is different from the first forced transfer mode not only in that the photosensitive drum 2 is not exposed, but also, in that the developing apparatus 4 is not driven.

When the internal humidity of the image forming apparatus is no more than a predetermined value, the image forming apparatus is operated in the forced transfer mode for low humidity, for every 100 copies, which is made different from the first forced transfer mode in terms of the development bias voltage Vdc, in order to reduce the amount by which toner is transferred onto the photosensitive drum 2, as it is in the second embodiment. In this embodiment, the development bias voltage Vdc is set to −150 V (Vdc=−150 V). As described above, when humidity is low, the amount by which toner is given triboelectric charge is greater, and the greater the amount of the triboelectric charge toner has, the greater the coulometric force between the toner and photosensitive drum 2, and therefore, the greater the amount of the force which acts to keep the toner adhered to the photosensitive drum 2. This creates the problem that the toner moves past the cleaning blade 51, although only by a small amount. As for the countermeasure against this problem, the following method is taken because in this embodiment, one of the reversal developing methods is employed. That is, in the first forced transfer mode, the development bias voltage Vdc is set to −300 V (Vdc=−300 V), whereas in the forced transfer mode for low humidity, the development bias voltage Vdc is set to −150 V (Vdc=−150 V) in order to make the amount by which toner is forced to transfer onto the photosensitive drum 2 in the forced transfer mode for low humidity, smaller than that in the first forced transfer mode, by making the forced transfer mode for low humidity in this embodiment, smaller in the difference in potential level between the development bias voltage Vdc and the potential level V1 of the exposed point on the peripheral surface of the photosensitive drum 2 than that in the first forced transfer mode. With the employment of the above described controlling method, the frequency with which toner moves past the cleaning blade 51 can be substantially reduced. In the forced transfer mode for low humidity, the toner 41 is moved past the transfer charging device 6, without the presence of the transfer medium 7 between the transfer charging device 6 and the toner 41. Therefore, in order to prevent the transfer charging device 6 from being soiled, the transfer bias voltage Vtr is set to zero (Vtr=0 V).

Figure 8:
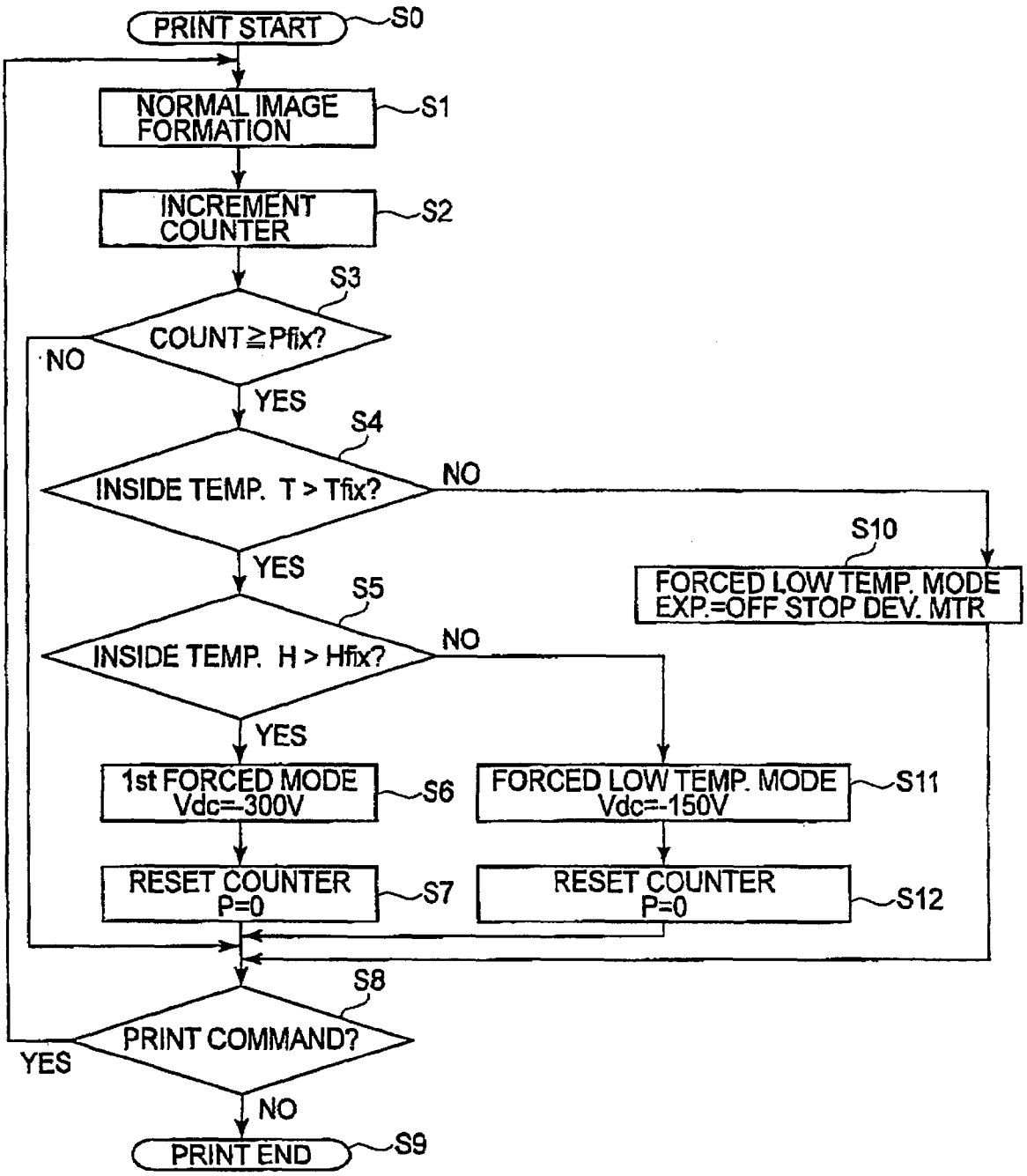
FIG. 8 is a flowchart of another example of the developer transfer controlling process in accordance with the present invention.

FIG. 8 is a flowchart of the image forming operation in this embodiment, which will be described below.

As a printing operation is started (S0), the image forming apparatus is operated in the normal image formation mode (S1), and one is added to the value P in the counter 20 (S2).

Then, the controlling means 21 determines whether or not the value P in the counter 20 is no less than the predetermined value Pfix (S3). When the value P in the counter 20 is less than Pfix, the controlling means 21 determines whether there is the next print demand or not (S8). When there is the next print demand, the image forming apparatus is operated in the normal image formation mode (S1). In this embodiment, Pfix is 100 (Pfix=100).

When there is no print demand, the printing operation is ended (S9).

When the controlling means 21 determines that the value P in the counter 20 is no less than the predetermined value Pfix, which in this embodiment is 100 (S3), the controlling means 21 determines whether the internal temperature T of the image forming apparatus detected by the ambience detection sensor 12 is higher than Tfix (S4). In this embodiment, the predetermined value Tfix is 10° C. (Tfix=10° C.).

When the internal temperature T detected by the ambience detection sensor 12 is higher than the predetermined value Tfix, the controlling means 21 determines whether or not the internal humidity H of the image forming apparatus detected by the ambience detection sensor 12 is higher than a predetermined value Hfix (S5). In this embodiment, the predetermined value Hfx is 30% RH (Hfix=30% RH).

When the internal humidity H of the image forming apparatus detected by the ambience detection sensor 12 is higher than the predetermined value Hfix, the image forming apparatus is operated in the above described first forced transfer mode (S6), and the counter 20 is reset; the value P in the counter 20 is changed to zero (P=0) (S7).

Next, it is determined whether there is a print demand or not (S8). When there is a print demand, the image forming apparatus is operated in the normal image formation mode (S1).

Then, the controlling means 21 determines whether or not the internal temperature of the image forming apparatus detected by the ambience detection sensor 12 is higher than the predetermined value Tfix (S4). When the internal temperature T of the image forming apparatus is no more than the predetermined value Tfix, the operational mode of the image forming apparatus is switched to the forced transfer mode for low temperature. More concretely, the photosensitive drum 2 is not exposed by the scanner unit 1, and the driving of the development motor 7 is stopped to keep the developing apparatus 4 inactive, with the development bias voltage Vdc set to −300 V (Vdc=−300 V). In other words, the image forming apparatus is operated as if it is in the forced transfer mode, without forcing toner to transfer onto the photosensitive drum 2 (S10).

Thereafter, it is determined whether or not there is a print demand, without changing the value P in the counter 20 (S4).

With the implementation of the above described controlling method, when the internal temperature T of the image forming apparatus is no more than the predetermined value Tfix, the operational mode of the image forming apparatus is switched to the forced transfer mode for low temperature, in which toner is not transferred onto the photosensitive drum 2. As for the value in the counter 20, it is increased by one each time an image is formed by the image forming apparatus in the normal image formation mode, even if the internal temperature T of the apparatus is no more than the predetermined value Tfix. In other words, in this embodiment, the image forming apparatus is designed so that when its internal temperature T is higher than the predetermined value Tfix, it is operated in the first forced transfer mode.

If the controlling means 21 determines that the internal humidity H of the image forming apparatus detected by the ambience detection sensor 12 is no more than the predetermined value Hfix (S5), the operational mode of the image forming apparatus is switched to the forced transfer mode for low humidity. More concretely, the development bias voltage Vdc is switched to −150 V (Vdc=−150 V) to operate the image forming apparatus in the condition in which the amount by which toner is forced to transfer onto the photosensitive drum 2 is smaller than that in the first forced transfer mode (S11).

Thereafter, the counter 20 is reset; the value P in the counter 20 is set to zero (P=0) (S12). Then, it is determined whether there is a print demand (S8), and when there is a print demand, the image forming apparatus is operated in the normal image formation mode (S1).

In an experiment in which the image forming apparatus in this embodiment was used several days during the winter, outputting roughly 5,000 copies, in a plain office, such as an office in a prefabricated building, in which temperature and humidity varied in the range of 2° C.-15° C., and 20% RH-45% RH, respectively, not only did the unsatisfactory cleaning of the photosensitive drum 2 not occur even once, but also, satisfactory images, that is, images satisfactory in that they did not suffer from such problems as the low density and/or fog, were continuously formed.

As for the threshold values for the internal temperature and humidity of the image forming apparatus, they are optional; they may be changed as necessary.

As described above, in this embodiment, (1) when the internal temperature of the image forming apparatus is higher than the predetermined value (first ambience), the image forming apparatus is operated in the first forced transfer mode, in which toner is forced to transfer onto the photosensitive drum 2, for every predetermined number copies, by the amount equal to the amount by which toner is borne on the development roller 42 or toner supply roller 43 per full rotation of the developer bearing member or developer supply member; (2) when the internal temperature of the image forming apparatus is no more than the predetermined value (second ambience), the image forming apparatus is operated in the forced transfer mode for low temperature, in which the developing apparatus is kept inactive to ensure that no toner is forced to transfer onto the photosensitive drum 2; and (3) when the internal humidity of the image forming apparatus is no more than the predetermined value (second ambience), the image forming apparatus is operated in the forced transfer mode for low humidity, in which the amount by which the deteriorated toner is forced to transfer onto the photosensitive drum 2 is smaller than that in the first forced transfer mode. With the implementation of the above described controlling method, it is possible to always obtain images of good quality, that is, images satisfactory in that they do not suffer from the fog and/or low density that is attributable to the toner deterioration in the developing apparatus. Further, when the image forming apparatus is operated in the low temperature ambience, the developing apparatus is kept inactive while the image forming apparatus is operated in the forced transfer mode. Therefore, even if the image forming apparatus is operated in the low temperature ambience for a substantial length of time, as in the above described experiment, it is possible to always satisfactorily clean the photosensitive drum 2 with the cleaning blade 51 while preventing the toner deterioration attributable to the very operation of the developing apparatus 4.

Incidentally, the control for keeping the development roller 47 stationary may be carried out in the forced transfer mode for low humidity mode.

Embodiment 4

Also in this embodiment, the amount by which the deteriorated toner is forced to transfer onto the photosensitive drum 2 is varied in response to the changes in the internal ambience of the image forming apparatus, in order to ensure that the peripheral surface of the photosensitive drum 2 is always satisfactorily cleaned by the cleaning blade without negatively affecting the developmental performance of the image forming apparatus (developing apparatus). However, if the image forming apparatus is prevented from being operated in the forced transfer mode when it is operated in the ambience in which temperature and humidity are low, the amount by which the deteriorated toner is forced to transfer from the developing apparatus onto the photosensitive drum is substantially smaller than otherwise. As a result, the deteriorated toner gradually accumulates in the developing apparatus. Thus, in this embodiment, the deteriorated toner in the developing apparatus is consumed by the following method, which characterized this embodiment. That is, the length of the time the photosensitive drum is exposed in the forced transfer mode is measured, and while no image is formed, toner is forced to transfer from the developing apparatus onto the photosensitive drum by the amount equal to the amount by which the deteriorated toner would have been transferred onto the photosensitive drum, if the image forming apparatus were not prevented from being operated in the forced transfer mode.

Next, the characteristics of this embodiment will be described in detail. In terms of the basic structures of the image forming apparatus and process cartridge, this embodiment is identical to the first embodiment. Therefore, the components of the image forming apparatus in this embodiment, which are identical to those in the first embodiment, are given the same referential symbols as those given in the first embodiment, and will not be described in detail.

Figure 9:
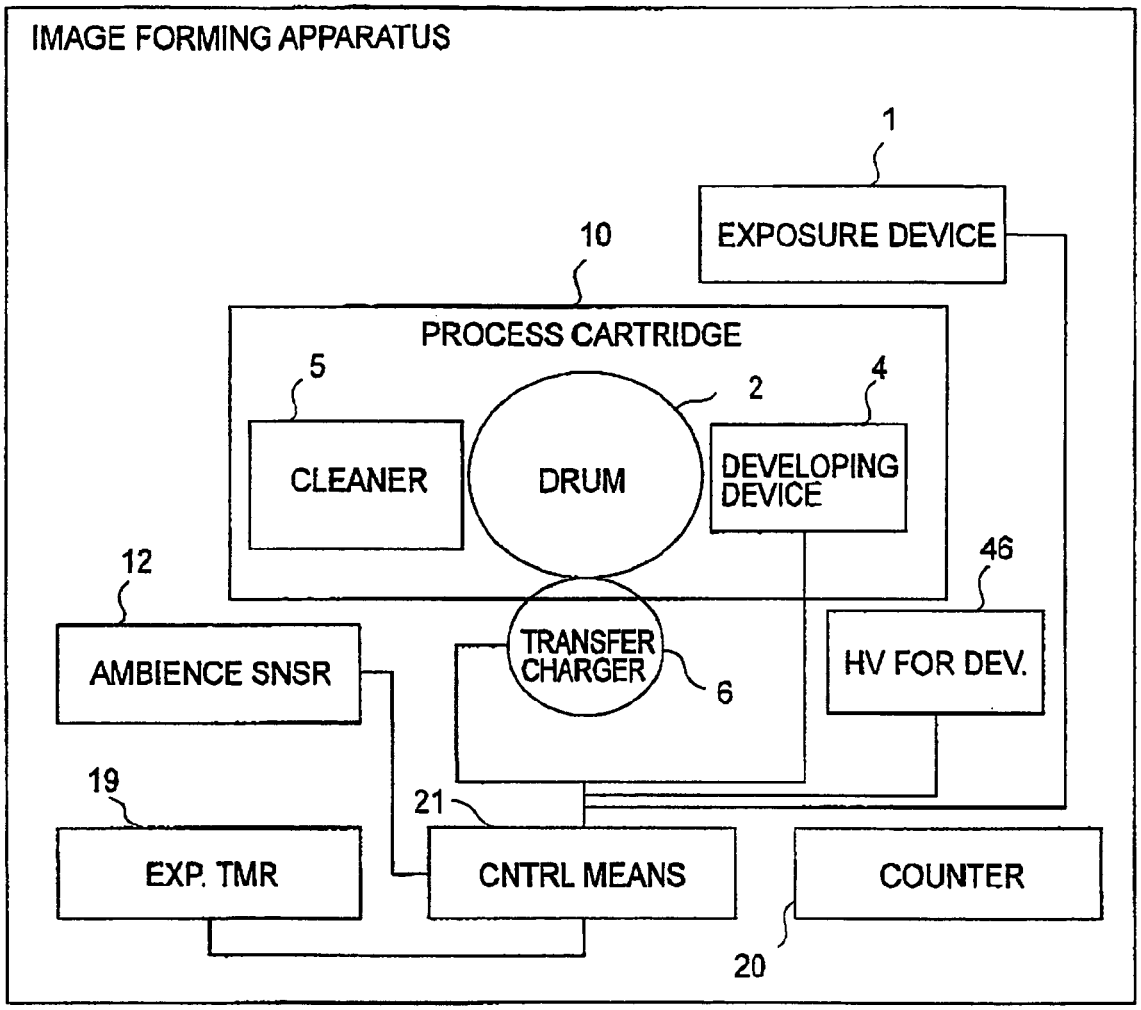
FIG. 9 is a block diagram of another example of the developer transfer controlling means in accordance with the present invention.

Referring to FIG. 9, also in this embodiment, the controlling means 21 is connected to the exposing apparatus 1, developing apparatus 4, transfer charging device 6, etc., in order to initialize the toner 41 in the developing apparatus 4, as it is in the first embodiment, and controls the process of forming an image on the transfer medium 7 based on the image formation data inputted from the unshown host computer or the like, as it does in the first embodiment.

To the controlling means 21, the transfer medium counter 20 is connected, which is a device for counting the number of transfer mediums 7 onto which an image is formed in the normal image formation mode. The controlling means 21 reads the value in the counter 20, and as the value in the counter 20 reaches a predetermined value, the controlling means 21 causes the image forming apparatus to operate in the forced transfer mode in which toner is forced to transfer from the developing apparatus 4 onto the photosensitive drum 2. In this embodiment, the image forming apparatus is made to operate in the forced transfer mode for every 100 transfer mediums 7.

Each time the image forming apparatus is caused to operate in the forced transfer mode, the counter 20 is reset to start cumulatively counting again the number of the copies outputted while the image forming apparatus is operated in the normal image formation mode.

To describe more concretely the forced transfer mode in this embodiment, first, the controlling means 21 temporarily interrupts the normal image formation mode, stopping thereby the conveyance of the transfer medium 7. Then, it causes the scanner unit 1 to scan the peripheral surface of the photosensitive drum 2 across the entire range of the peripheral surface of the photosensitive drum 2 in terms of the primary scanning direction, and by a predetermined width in terms of the secondary scanning direction, in order to form a latent image different from the latent image formed in accordance with the image formation data inputted from the host computer or the like.

Next, the development bias is applied to the developing apparatus 4. As a result, the toner 41 in the developing apparatus 4 is transferred onto the peripheral surface of the photosensitive drum 2, in the pattern of the latent image different from the latent image formed on the photosensitive drum 2 in the normal image formation mode. Consequently, the toner in the developing apparatus 4 is initialized (refreshed).

Next, the toner 41 which was forced to transfer onto the photosensitive drum 2 is recovered by the cleaning apparatus 5 as the photosensitive drum 2 is rotated. In this forced transfer mode in this embodiment, however, the toner 41 (toner image) on the peripheral surface of the photosensitive drum 2 is moved past the transfer charging device 6, without the presence of the transfer medium 7 between the toner 41 and transfer charging device 6. Therefore, in order to prevent the transfer roller 6 from being soiled, the transfer bias voltage Vtr is set to zero (Vtr=0).

Up to this point, the operational modes in this embodiment are the same as the forced transfer mode in the first embodiment, and the first forced transfer modes in the second and third embodiments. In this embodiment, however, the exposure timer 19 for measuring the length of exposure time while the image forming apparatus is operated in the forced transfer mode is connected to the controlling means 21 as shown in FIG. 9. With the provision of this exposure timer 19, the deficiency in the exposure time relative to the normal exposure time in the forced transfer mode is recorded. This forced transfer mode in this embodiment, in which the exposure timer 19 is used is called the second forced transfer mode.

Here, the exposure time in the second forced transfer mode means the length of time the peripheral surface of the photosensitive drum 2 is actually exposed to the beam of laser light while the image forming apparatus is operated in the second forced transfer mode. In other words, the length of exposure time the exposure timer 19 measures is proportional to the amount by which the toner 41 in the developing apparatus 4 is forced to transfer onto the photosensitive drum 2 in the second forced transfer mode.

To describe more concretely, the exposure times 19 uses, as the referential condition of the image forming apparatus, the condition in which the internal ambience of the image forming apparatus does not changes, that is, the internal humidity of the image forming apparatus remains above the predetermined value, and therefore, the image forming apparatus is consistently operated with such a timing that is tied to the specific number of outputted copies, which is 100 in this embodiment. In other words, as the image forming apparatus is consistently operated in the forced transfer mode for every 100 transfer mediums 7, the exposure time is consumed to zero; the value in the exposure timer 19 is reduced to zero. However, if the forced transfer mode is interrupted, or the peripheral surface of the photosensitive drum 2 is exposed by the size smaller than the referential size, because the internal ambience of the image forming apparatus has changed to the low temperature/low humidity ambience, or the like reason, the deficiency in the length of exposure time relative to the referential length of exposure time, that is, the portion of the exposure time, which was not consumed, is measured by the exposure timer 19. The photosensitive drum is rotated at the predetermined peripheral velocity, and the width of the primary scanning range is constant. Therefore, the length of exposure time is equal to the length of time the peripheral surface of the photosensitive drum 2 is exposed in terms of the secondary scanning direction. Therefore, the size of the exposed area means the same as the length of the exposure time.

The width, in terms of the secondary scanning direction, by which the peripheral surface of the photosensitive drum 2 is exposed by the exposing apparatus 1 is desired to be no less than the circumference of the development roller 42 or developer supply roller 43, for the following reason.

That is, in this embodiment, the circumference of the development roller 42 is 33.4 mm, and the circumference of the toner supply roller 43 is 41.8 mm. Therefore, by setting the exposure width in terms of the secondary scanning direction to 62.7 mm, which is equal to 1.5 times the circumference of the toner supply roller 43, being therefore greater than the circumference of the development roller 42, it is ensured that the toners on the two rollers 42 and 43 are both forced to thoroughly transfer onto the photosensitive drum 2.

In this case, the length of exposure time in the forced transfer mode is 0.6 second. In this embodiment, therefore, the abovementioned referential exposure time for the exposure timer 19 is set to 0.6 second. With the referential exposure time for the exposure timer 19 set to 0.6 second, the developer can be expelled onto the latent image on the peripheral surface of the photosensitive drum 2 by the amount equal to the sum of the amount by which developer is borne on the peripheral surface of the toner supply roller 43 per rotation of the toner supply roller 43, and the amount by which developer is borne on the peripheral surface of the development roller 42 per rotation of the development roller 42.

The thickness of the toner layer formed of the toner borne on the peripheral surface of the development roller 42 is constant, because it is regulated by the development blade 44 as described before. Therefore, the amount by which the toner is borne on the peripheral surface of the development roller 42 per rotation of the development roller 42 is constant. Thus, in this specification, the amount by which toner is forced to transfer onto the photosensitive drum 2 is determined by the circumference of the development roller 42, or the circumference of the toner supply roller 43 which rotates with the development roller 42.

As for the controlling means 21, not only is the exposure timer 19 connected thereto, but also, the ambience detection sensor 12 is connected thereto. In this embodiment, the ambience detection sensor 12 detects the internal temperature of the image forming apparatus, and the controlling means 21 continuously monitors whether or not the internal temperature of the image forming apparatus is higher than the predetermined value. When the internal temperature is no more than the predetermined value, the controlling means 21 prevents the image forming apparatus from being operated in the forced transfer mode for every 100 transfer mediums 7.

More concretely, when the internal temperature of the image forming apparatus is no more than 10° C. (threshold value) below which the cleaning blade 51 reduces in resiliency, the controlling means prevents the image forming apparatus from being operated in the forced transfer mode, for the following reason. That is, the toner recovered by the cleaning apparatus 5 in the forced transfer mode is equivalent to the transfer residual toner recovered by the cleaning means 5 in the normal image formation mode, being therefore smaller in terms of the amount per unit area of the peripheral surface of the photosensitive drum. In comparison, the toner recovered in the second forced transfer mode does not go through the transfer step, being thereby substantially greater in the amount per unit area than the transfer residual toner. Therefore, in order to prevent the frequency of the unsatisfactory cleaning of the photosensitive drum from increasing in the low temperature ambience, the controlling means 21 prevents the image forming apparatus from being operated in the forced transfer mode when the internal temperature of the image forming apparatus is no more than the predetermined value.

In this embodiment, each time the image forming apparatus is prevented from being operated in the forced transfer mode for every 100 copies, 0.6 second is added to the value in the exposure timer 19. In other words, when the image forming apparatus is not operated in the second forced transfer mode because the low temperature and/or low humidity continues, or the like reason, the value in the exposure timer 19 cumulatively increases.

Also, each time the image forming apparatus is prevented from being operated in the second forced transfer mode for every 100 copies, the deteriorated toner in the developing apparatus 4 increases by the amount equal to the amount by which toner would have been transferred onto the photosensitive drum 2 if the image forming apparatus were operated in the forced transfer mode when the internal temperature and/or humidity is no less than the predetermined value. Therefore, the amount by which toner is forced to transfer from the developing apparatus 4 onto the photosensitive drum 2 when the image forming apparatus is operated in the second forced transfer mode for the first time increases. However, when the amount by which toner was forced to transfer onto the photosensitive drum 2 per transfer was equal to the amount by which toner was borne on the peripheral surface of the developer supply roller 43 per 1-1.5 times the rotation thereof, it did not occur that the photosensitive drum 2 was unsatisfactorily cleaned.

On the other hand, if the above described amount by which toner is forced to transfer onto the photosensitive drum 2 is made to be no less than the amount by which toner is borne on the toner supply roller 43 per rotation of the toner supply roller 43, the amount of load which applies to the cleaning blade 51 becomes excessive, allowing the photosensitive drum 2 to be slightly unsatisfactorily cleaned, at the temperature level (which is roughly 15° C. in this embodiment). As for the threshold value Tfix for the internal temperature of the image forming apparatus, it is optional; it may be altered as necessary in accordance with the properties of the cleaning blade 51.

Thus, in this embodiment, in order to prevent the photosensitive drum 2 from being unsatisfactorily cleaned, the amount by which toner is to be forced to transfer onto the photosensitive drum 2 in the second forced transfer mode is made to be no more than the twice the amount by which toner is borne on the peripheral surface of the toner supply roller 43 per rotation of the toner supply roller 43.

In addition, as long as the internal temperature of the image forming apparatus is higher than the predetermined value (which is 10° C. in this embodiment), and also, the value in the exposure timer 19 is zero, the image forming apparatus is operated in the above described second forced transfer mode. However, when the value in the exposure timer 19 is greater than zero, the amount by which toner is forced to transfer each time the image forming apparatus is operated in the forced transfer mode is kept at a value greater than the amount by which toner is forced to transfer in the second forced transfer mode, until the value in the exposure timer 19 becomes zero. This operational mode in which the amount by which toner is forced to transfer is greater than the amount by which toner is forced to transfer in the second forced transfer mode is called the forced transfer mode for recovery.

To describe more concretely, when the internal temperature of the image forming apparatus is higher than 10° C., and the value in the exposure timer 19 is greater than zero, the amount by which toner is forced to transfer per transfer is made equal to twice the amount by which toner is borne on the peripheral surface of the toner supply roller 43 per rotation of the toner supply roller 43, that is, the amount proportional to the twice the circumference of the toner supply roller 43, or 83.6 mm. In comparison, the amount by which toner is to be forced to transfer in the second forced transfer mode when the value in the exposure timer 19 is greater than zero is equal to 1.5 time the amount by which toner is borne on the peripheral surface of the toner supply roller 43 per rotation of the toner supply roller 43.

The reason for the above described arrangement is to prevent the progression of the toner deterioration in the developing apparatus 4 attributable to the smaller amount by which toner is forced to transfer in the second forced transfer mode.

In this embodiment, the value in the exposure timer 19 is reduced by 0.2 second per forced toner transfer in the forced transfer mode for recovery, and the image forming apparatus is operated in the forced transfer mode for recovery until the value in the exposure timer 19 becomes zero.

By measuring the length of the exposure time, even when the image forming apparatus is prevented from being operated in the forced transfer mode for every 100 copies, because the low internal temperature and/or humidity of the image forming apparatus continues, the toner 41 can be forced to transfer onto the photosensitive drum 2 in the forced transfer mode for recovery, by the amount equal to the amount by which toner would have been forced to transfer if the image forming apparatus were allowed to be operated in the forced transfer mode.

Figure 10:
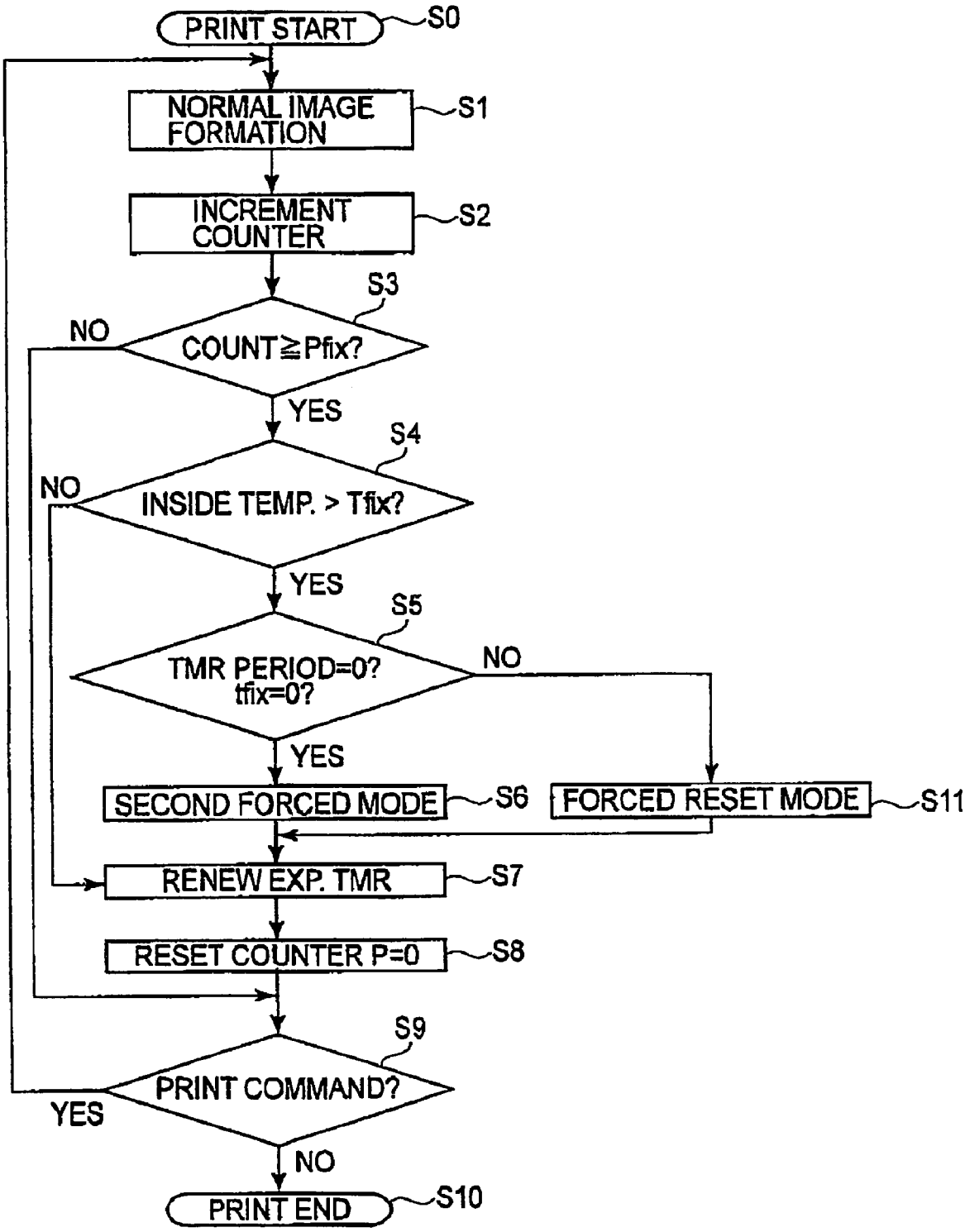
FIG. 10 is a flowchart of another example of the developer transfer controlling process in accordance with the present invention.

FIG. 10 is a flowchart of the image forming operation in this embodiment, which will be described below.

As a printing operation is started (S0), the image forming apparatus is operated in the normal image formation mode (S1), and one is added to the value P in the counter 20 (S2).

Then, the controlling means 21 determines whether or not the value P in the counter 20 is no loss than the predetermined value Pfix (S3). When the value P in the counter 20 is less than Pfix, the controlling means 21 determines whether there is a print demand or not (S9). When there is a print demand, the image forming apparatus is operated in the normal image formation mode (S1). In this embodiment, Pfix in 100 (Pfix=100).

When there is no print demand, the printing operation is ended (S10).

When the controlling means 21 determines that the value P in the counter 20 is no less than the predetermined value Pfix (S3), the controlling means 21 determines whether the internal temperature T of the image forming apparatus detected by the ambience detection sensor 12 is higher than Tfix (S4). In this embodiment, Tfix is 10° C. (Tfix=10° C.).

When the internal temperature T detected by the ambience detection sensor 12 is higher than the predetermined value Tfix, the controlling means 21 determines whether or not the value t in the exposure timer 19 is zero (S5).

When the value t in the exposure timer 19 is greater than zero (t>0), the image forming apparatus is operated in the forced transfer mode for recovery (S11), whereas when the value t in the exposure timer 19 equals zero (t=0), the image forming apparatus is operated in the second forced transfer mode (S6), and the exposure timer 19 is reset to the referential value (S7). Then, the counter 20 is reset; the value P in the counter 20 is changed to zero (P=0) (S8).

In this embodiment, the exposure time in the forced transfer mode for recovery is set to 0.8 second, which is equal to the time it takes for the toner supply roller 43 to rotate twice, and the exposure time in the second forced transfer mode is set to 0.6 second, which is equal to the time it takes for the toner supply roller 43 to rotate 1.5 times.

Thereafter, it is determined whether there is a print demand or not (S9). When there is a print demand, the image forming apparatus is operated in the normal image formation mode (S1).

When the internal temperature T of the image forming apparatus detected by the ambience detection sensor 12 is no more than the predetermined value Tfix, the value t in the exposure timer 19 is renewed without operating the image forming apparatus in the forced transfer mode. Then, it is determined whether or not there is a print demand (S9).

When the internal temperature T of the image forming apparatus is no more than the predetermined value Tfix, the image forming apparatus is not operated in the forced transfer mode. However, the value P in the counter 20 is increased by one each time the image forming apparatus is operated in the normal image formation mode. In other words, the image forming apparatus is structured so that when the internal temperature of the image forming apparatus is higher than the predetermined value Tfix, the image forming apparatus is operated in the second forced transfer mode.

In an experiment in which the image forming apparatus in this embodiment was used several days during the winter, outputting roughly 5,000 copies, in an office in which temperature varied in the range of 5° C.-20° C., not only did the unsatisfactory cleaning of the photosensitive drum 2 not occur even once, but also, satisfactory images, that is, images satisfactory in that they did not suffer from such problems as the low density and/or fog, were continuously formed.

Further, when the internal temperature of the image forming apparatus is higher than the predetermined value, and the length of the exposure time in the forced transfer mode is insufficient for compensating for the deficiency of the exposure time attributable to the continual operation of the image forming apparatus in the second forced transfer mode, the deficiency is compensated for by making the amount by which the deteriorated toner is to be forced to transfer onto the photosensitive drum 2, equal to twice the amount by which toner is borne on the peripheral surface of the toner supply roller 43 per rotation of the toner supply roller 43.

In comparison, when the length of the time the photosensitive drum 2 is exposed in the second forced transfer mode is not insufficient with reference to the length of time the photosensitive drum 2 is exposed while the image forming apparatus is continuously operated in the normal image formation mode, the amount by which the deteriorated toner is to be forced to transfer onto the photosensitive drum 2 is made smaller than the amount by which the deteriorated toner is to be forced to transfer onto the photosensitive drum 2 when the length of the time the photosensitive drum 2 is exposed in the second forced transfer mode is insufficient, that is, it is reduced to the value equal to 1.5 times the amount by which toner is borne on the toner supply roller 43 per rotation of the toner supply roller 43. Therefore, not only is it possible to continuously obtain images of good quality, that is, images satisfactory in that they do not suffer from the fog and/or low density attributable to the toner deterioration in the developing apparatus 4, but also, the photosensitive drum 2 is continuously satisfactorily cleaned by the cleaning blade 51.

In other words, when the internal temperature of the image forming apparatus is lower than the predetermined value, it is made impossible for the deteriorated toner to be forced to transfer onto the photosensitive drum 2. Moreover, while the image forming apparatus is operated in the forced transfer mode, the length of the exposure time is measured, and even when the internal temperature and/or humidity continues to be low, toner is forced to transfer onto the photosensitive drum 2 by the amount by which toner would have been forced to transfer if toner were allowed to be forced to transfer. Therefore, it is ensured that the deteriorated toner is consumed.

Further, in this embodiment, the image forming apparatus is operated in the second forced transfer mode for every predetermined number (which in this embodiment is 100) of transfer mediums 7. However, the predetermined number Pfix does not need to be limited to 100; the number of transfer mediums 7 for which the image forming apparatus is to be operated in the second forced transfer mode may be adjusted according to the structure of the developing apparatus 4 and the durability of the toner used in the developing apparatus 4.

Further, an arrangement may be made so that the length of time the developing apparatus 4 is operated in the normal image formation mode is cumulatively measured, and the image forming apparatus is operated in the forced transfer mode for every predetermined cumulative length of time the developing apparatus is operated in the normal image formation mode.

Also in this embodiment, the width, in terms of the secondary scanning direction, by which the photosensitive drum 2 is to be exposed while the image forming apparatus is operated in the second forced transfer mode is made equal to 1.5 times the circumference of the toner supply roller 43. However, it is optional, that is, it may be adjusted according to the diameter and peripheral velocity of the development roller 42, or the diameter and peripheral velocity of the toner supply roller 43. In other words, as long as the amount by which toner is to be forced to transfer onto the photosensitive drum 2 is no less than the amount by which toner is borne on the peripheral surface of the development roller 42 or the peripheral surface of the toner supply roller 43, the object of initializing the developing apparatus 4 can be accomplished to ensure that images of good quality, that is, images satisfactory in that they do not suffer from the fog and/or low density, will be continuously outputted.

Also in this embodiment, the width, in terms of the secondary scanning direction, by which the photosensitive drum 2 is exposed by the exposing apparatus 1 while the image forming apparatus is operated in the forced transfer mode for recovery is made equal to twice the circumference of the toner supply roller 43. However, when the internal temperature of the image forming apparatus is high enough for the resiliency of the cleaning blade 51 to be sufficient for ensuring that the photosensitive drum 2 is satisfactorily cleaned, the length of time the photosensitive drum 2 is to be exposed by the exposing apparatus 1 in the forced transfer mode for recovery may be extended until the value in the exposure timer 19 becomes zero.

As described above, in this embodiment, (1) when the internal temperature of the image forming apparatus is higher than the predetermined value (first ambience), the amount by which the deteriorated toner is forced to transfer onto the photosensitive drum is made equal to the amount by which toner is borne on the developer bearing member or developer supplying member per rotation thereof; (2) when the internal temperature of the image forming apparatus is lower than the predetermined value (second ambience), the deteriorated toner is not forced to transfer onto the photosensitive drum. Therefore, not only are images of good quality, that is, images satisfactory in that they do not suffer from the fog and/or low density attributable to the toner deterioration in the developing apparatus continuously formed, but also, the photosensitive drum is continuously satisfactorily cleaned by the cleaning blade. More over, (3) the length of exposure time is measured, and after the image forming apparatus is operated in the low temperature ambience, the amount by which toner is forced to transfer from the developing apparatus onto the photosensitive drum is increased, ensuring that the deteriorated toner in the developing apparatus is consumed.

In the first to fourth embodiments, the threshold value with which the internal temperature of the image forming apparatus was referenced to determine whether or not the internal ambience of the image forming apparatus was the low temperature ambience was 10° C., which was chosen based on the results, given in Table 1, of an experiment described below. In this experiment, the ambience detection sensor 12 was removed from the image forming apparatus. The temperature was changed from 10° C. to 20° C., by an increment of 5° C. The amount by which toner was forced to transfer onto the photosensitive drum 2 each time the image forming apparatus was operated in the second forced transfer mode was varied from the value equal to 1 to 2.5 times the amount by which toner is borne on the supply roller 43 per rotation thereof by an increment of 0.5 times the amount by which toner is borne on the supply roller 43 per rotation thereof. Under each condition, 5,000 copies were made to study the occurrences of the unsatisfactory cleaning of the photosensitive drum 2.

TABLE 1

| | | Temperature T (° C.) | | | |
|---|---|---|---|---|---|
| | | 10 | 15 | 20 | 25 |
| Amount of Transferred Toner per Forced Transfer (per × Rotations of Supply Roller | 1 | FN | G | G | G |
| | 1.5 | N | G | G | G |
| | 2 | N | G | G | G |
| | 2.5 | N | F | G | G |

G: No improper cleaning
F: Slight improper cleaning is observed.
EN: Improper cleaning is seen.
N: Improper cleaning is remarkable.

Embodiment 5

In this embodiment, when the internal temperature of the image forming apparatus is no more than a predetermined value, the amount by which toner is forced to transfer onto photosensitive drum is reduced in two steps.

The components of the image forming apparatus and process cartridge in this embodiment, which are identical to those in the above described first embodiment are given the same referential symbols as those given in the description of the first embodiment, and will not be described in detail here.

Referring to FIG. 9, also in this embodiment, to the controlling means 21, the exposure timer 19 for measuring the length of time the photosensitive drum is exposed while the image forming apparatus is operated in the second forced transfer mode is connected, and the deficiency of exposure time relative to the referential length of exposure time in the second forced transfer mode is recorded. The exposure time in the second forced transfer mode here means the length of time the photosensitive drum 2 is actually exposed to a beam of laser light while the image forming apparatus is operated in the second forced transfer mode.

More specifically, in the second forced transfer mode, a latent image, different from the latent image formed in accordance with the image formation data inputted from a host computer or the like, is formed, by exposing the photosensitive drum 2 by the exposing apparatus 1 across the entire range of the photosensitive drum 2 in terms of the primary scanning direction, and by a predetermined width in terms of the secondary scanning direction. Then, the toner 41 in the developing apparatus 4 is transferred onto the photosensitive drum 2 by applying development bias to the developing apparatus 4. As a result, the toner 41 in the developing apparatus 4 is initialized.

The toner 41 having been transferred onto the photosensitive drum 2 while the image forming apparatus was operated in the second forced transfer mode is recovered into the cleaning apparatus 5 as the photosensitive drum 2 is rotated. During this rotation of the photosensitive drum 2, the toner 41 is moved past the transfer charging device 6, without the presence of the transfer medium 7 between the toner 41 and transfer charging device 6, and therefore, in order to prevent the transfer charging device 6 from being soiled, the transfer bias voltage Vtr is set to 0 V (Vtr=0).

Also in this embodiment, in order to make it possible to simultaneously force both the toner on the development roller 42 and the toner on the toner supply roller 43 to transfer onto the photosensitive drum 2, the width, in terms of the secondary scanning direction, by which the photosensitive drum 2 is exposed by the exposing apparatus 1 in the secondary forced transfer mode is desired to be set to a value which is no less than the circumference (33.4 mm) of the development roller 42 or the circumference (41.8 mm) of the toner supply roller 43. In this embodiment, it is set to 62.7 mm, which is 1.5 times the circumference of the toner supply roller 43.

In this case, the length of exposure time in the forced transfer mode is 0.6 second. Therefore, the aforementioned referential length of exposure time for the exposure timer 19 in this embodiment is 0.6 second.

Also in this embodiment, not only is the exposure timer 19 connected to the controlling means 21, but also, the ambience detection sensor 12 is connected to the controlling means 21 to detect the internal ambience of the image forming apparatus. In this embodiment, the ambience detection sensor 12 detects the internal temperature of the image forming apparatus, enabling the controlling means 21 to constantly determine whether or not the internal temperature of the image forming apparatus is higher than the predetermined value.

This embodiment is characterized in that the image forming apparatus structured so that when the internal temperature of the image forming apparatus is no more than the predetermined value, it is enabled to be operated in two different operational modes, for every 100 copies, that is, a mode in which toner is not forced to transfer onto the photosensitive drum 2, or the mode (forced transfer mode) in which the amount by which toner is forced to transfer onto the photosensitive drum 2 per transfer is smaller than that in the second forced transfer mode.

More concretely, two temperature levels of 15° C. and 10° C. are selected as the threshold values, which are referenced to determine whether or not the internal temperature of the image forming apparatus is low enough to reduce the cleaning blade 51 in resiliency. That is, 15° C. is used as the threshold (referential) value below which the cleaning blade 51 moderately reduces in resiliency, whereas 10° C. is used as the threshold (referential) value below which the cleaning blade 51 drastically reduces in resiliency. Thus, when the internal temperature of the image forming apparatus is no more than 15° C., but higher than 10° C., the amount by which toner is to be forced to transfer onto the photosensitive drum in the second forced transfer mode is reduced from the value proportional to 62.7 mm, that is, 1.5 times the circumference of the toner supply roller 43, to the value proportional to 41.8 mm, or the circumference of the toner supply roller 43, whereas when the internal temperature of the image forming apparatus is no more than 10° C., the image forming apparatus is prevented from being operated in the second forced transfer mode, and the length of exposure time is measured by the exposure timer 19.

The above described arrangement is made for the following reason. That is, the toner recovered into the cleaning apparatus 5 in the normal image formation mode is the transfer residual toner, being therefore smaller in the amount per unit area of the peripheral surface of the photosensitive drum. As for the toner recovered into the cleaning apparatus 5 in the second forced transfer mode, it is not subjected to the transferring step, being therefore substantially greater in the amount per unit area than the transfer residual toner. Therefore, the above described arrangement is made to prevent the frequency of the unsatisfactory cleaning of the photosensitive drum 2 from increasing in the low temperature ambience in which the cleaning blade 51 is smaller in resiliency.

Hereafter, the force transfer mode in which the amount by which toner is forced to transfer onto the photosensitive drum per transfer is smaller than that in the second forced transfer mode will be called the preventive forced transfer mode. In this embodiment, the value in the above described exposure timer 19 is increased by 0.2 second each time toner is forced to transfer in the preventive forced transfer mode. Each time it is prevented that the image forming apparatus is operated in the second forced transfer mode for every 100 copies, 0.6 second is added to the value in the exposure timer 19.

When the internal temperature of the image forming apparatus is no less than the predetermined value, and the value in the exposure timer 19 is zero, the image forming apparatus is operated in the above described second forced transfer mode.

However, when the value in the exposure timer 19 is greater than zero, the image forming apparatus is operated in the forced transfer mode for recovery, in which the amount by which toner is forced to transfer per transfer is greater than that in the second forced transfer mode.

More specifically, in this embodiment, when the internal temperature of the image forming apparatus is no less than 15° C., and also, the value in the exposure timer 19 is greater than zero, the image forming apparatus is operated in the forced transfer mode for recovery, in which the amount by which toner is forced to transfer per transfer is set to a value proportional to 83.6 mm, that is, twice the circumference of the toner supply roller 43.

The above arrangement is made to prevent the problem that because the image forming apparatus is operated in the preventive forced transfer mode, or is prevented from being operated in the forced transfer mode, the toner deterioration in the developing apparatus is exacerbated. As described above, the amount by which toner is forced to transfer per transfer in the forced transfer mode for recovery is greater than that in the second forced transfer mode.

In other words, in this embodiment, for every 100 copies, the image forming apparatus is operated in the second forced transfer mode in which toner is forced to transfer from the developing apparatus onto the photosensitive drum. To describe in more detail, whether or not the internal ambience of the image forming apparatus is the low temperature ambience is determined with reference to two threshold values, which are referenced to prevent the image forming apparatus from being operated in the forced transfer mode, or to operate the image forming apparatus in the preventive forced transfer mode, and the length of exposure time is measured. Then, as the cumulative length of exposure time reaches a predetermined value, the image forming apparatus is operated in the force transfer mode for recovery to force toner to transfer onto the photosensitive drum 2 by a greater amount.

Regarding the amount by which toner is forced to transfer onto the photosensitive drum 2 per transfer when the internal ambience of the image forming apparatus is not the low temperature/low humidity ambience, when it fell in the range of 1-1.5 times the amount by which toner was borne on the toner supply roller 43 per rotation thereof, there was no noticeably unsatisfactory cleaning of the photosensitive drum 2. However, as it was increased to exceed twice the amount by which toner is borne on the toner supply roller 43 per rotation, the cleaning blade 51 began to be overloaded roughly at the temperature level below which rubber gradually reduced in resiliency, which was about 15° C. in this embodiment, allowing the toner to slip past the cleaning blade 51, although by only a small amount. Therefore, even in the forced transfer mode for recovery, the amount by which toner was to be forced to transfer was kept below twice the amount by which toner was borne on the toner supply roller 43 per rotation.

Figure 11:
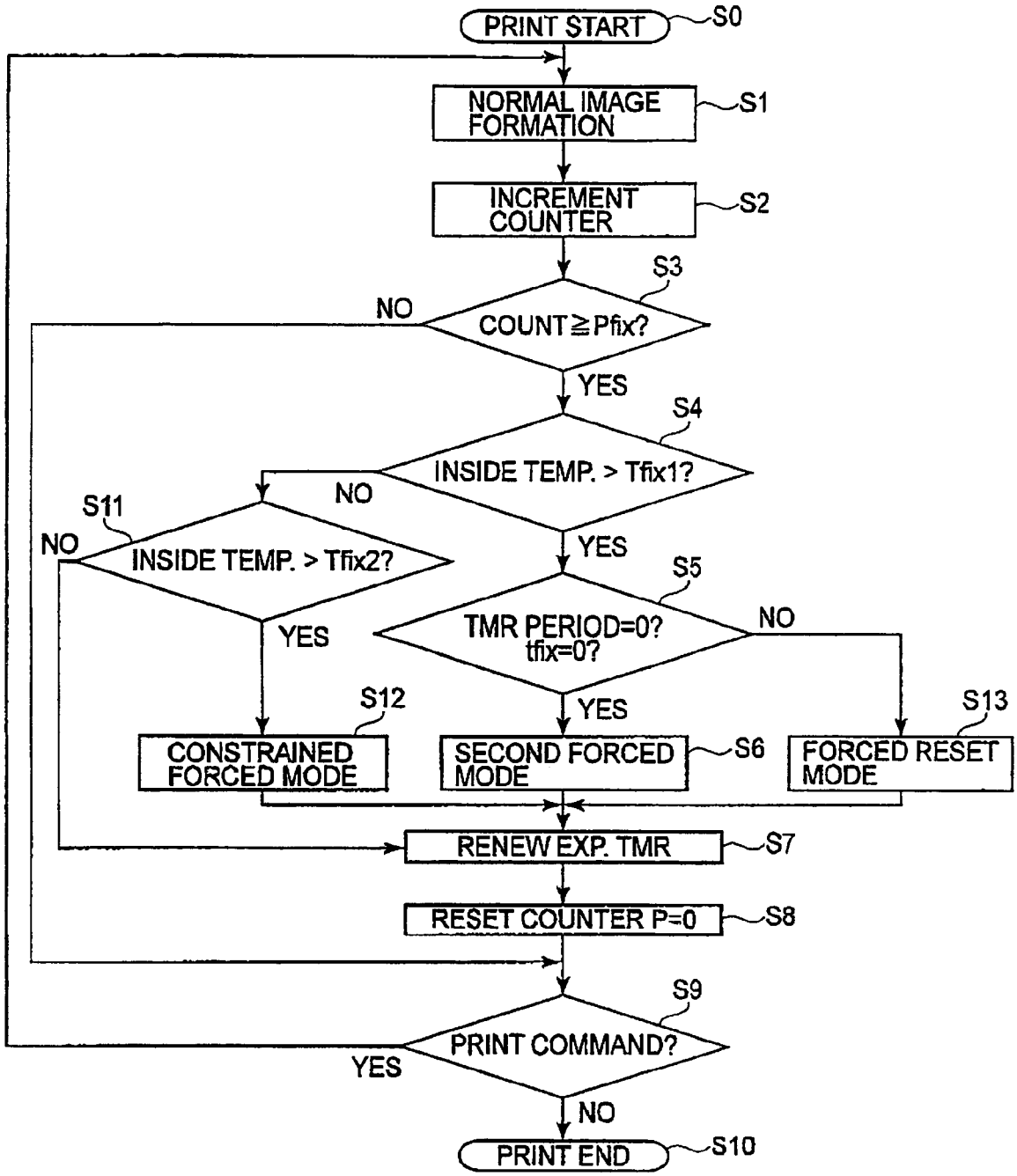
FIG. 11 is a flowchart of another example of the developer transfer controlling process in accordance with the present invention.

FIG. 11 is the flowchart of the image forming operation carried out by the image forming apparatus in this embodiment, which will be described next. As a printing operation is started (S0), the image forming apparatus is operated in the normal image formation mode (S1), and one is added to the value P in the counter 20 (S2). Then, the controlling means 21 determines whether or not the value P in the counter 20 is no less than the predetermined value Pfix (S3). When the value P in the counter 20 is less than Pfix, the controlling means 21 determines whether there is a print demand or not (S9). When there is a print demand, the image forming apparatus is operated in the normal image formation mode (S1). In this embodiment, Pfix is 100 (Pfix=100).

When there is no print demand, the printing operation is ended (S10).

When the controlling means 21 determines that the value P in the counter 20 is no less than the predetermined value Pfix, which in this embodiment is 100 (S3), the controlling means 21 determines whether the internal temperature T of the image forming apparatus detected by the ambience detection sensor 12 is greater than Tfix (S4). In this embodiment, Tfix is 15° C.

When the internal temperature T detected by the ambience detection sensor 12 is greater than the predetermined value Tfix1, the controlling means 21 determines whether or not the value t in the exposure timer 19 is zero (S5).

When the value t in the exposure timer 19 is greater than zero (t>0), the image forming apparatus is operated in the forced transfer mode for recovery (S13), whereas when the value t in the exposure timer 19 equals zero (t=0), the image forming apparatus is operated in the second forced transfer mode (S6), and the exposure timer 19 is renewed (S7). Then, the counter 20 is reset; the value P in the counter 20 is changed to zero (P 0) (S8).

In this embodiment, the length of exposure time in the forced transfer mode for recovery is set to 0.9 second, which is proportional to the time it takes for the toner supply roller 43 to rotate twice, and the length of exposure time in the second forced transfer mode is set to 0.6 second, which is proportional to the time it takes for the toner supply roller 43 to rotate 1.5 times.

Thereafter, it is determined whether there is a print demand or not (S9). When there is a print demand, the image forming apparatus is operated in the normal image formation mode (S1). When the internal temperature T of the image forming apparatus detected by the ambience detection sensor 12 is no more than the predetermined value Tfix1, it is determined whether or not the internal temperature T is higher than the predetermined second value Tfix2 (S11). In this embodiment, the second predetermined value Tfix2 is 10° C.

When the internal temperature T of the image forming apparatus is higher than the predetermined value Tfix2, the image forming apparatus is operated in the preventive forced transfer mode (S12), and the value in the exposure timer 19 is renewed (S7). Then, the transfer medium counter 20 is reset; the value P in the counter 20 is changed to zero (S8). In this embodiment, the length of exposure time in the preventive forced transfer mode is set to 0.4 second, which is equal to the time it takes for the toner supply roller 43 to make a single full rotation.

Then, it is determined whether or not there is a print demand (S9). When there is a print demand, the image forming apparatus is operated in the normal image formation mode (S1). When the internal temperature T is no more than Tfix2, the value t in the exposure timer 19 is renewed without operating the image forming apparatus in the forced transfer mode. Then, it is determined whether or not there is a print demand (S9).

When the internal temperature T is no more than Tfix2, the image forming apparatus is not operated in the forced transfer mode. However, even when the internal temperature T is no more than Tfix, one is added to the value P in the counter 20 each time an image is formed in the normal image formation mode. Therefore, when the internal temperature T is higher than the predetermined value Tfix2, the image forming apparatus is operated in the forced transfer mode.

In an experiment in which the image forming apparatus in this embodiment was used several days during the winter, outputting roughly 5,000 copies, in an office in which temperature varied in the range of 5° C.-20° C., not only did the unsatisfactory cleaning of the photosensitive drum 2 not occur even once, but also, satisfactory images, that is, images satisfactory in that they did not suffer from such problems as the low density and/or fog, were continuously formed.

As described above, in this embodiment, (1) when the internal temperature of the image forming apparatus is lower than the predetermined first value (second ambience), the deteriorated toner is forced to transfer onto the photosensitive drum by a smaller amount than otherwise; (2) when the internal temperature of the image forming apparatus is lower than the predetermined second value, which is smaller than the predetermined first value (second ambience), the process of transferring the deteriorated toner onto the photosensitive drum 2 is not carried out; (3) when the internal temperature of the image forming apparatus is higher than the predetermined value (first ambience), and also, the length of time the photosensitive drum is exposed in the forced transfer mode is smaller than the length of time by which the photosensitive drum would have been exposed if the developer were forced to transfer onto the image bearing member during the period in which no image is formed, the amount by which toner is to be forced to transfer onto the photosensitive drum is increased to compensate for the shortage in the exposure time; (4) when the internal temperature of the image forming apparatus is higher than the predetermined value (first ambience), and also, the length of time the photosensitive drum is exposed in the forced transfer mode is not shorter than the length of time the photosensitive drum would have been exposed if the developer were forced to transfer from the developing apparatus onto the photosensitive drum during the period in which no image is formed, the amount by which the deteriorated toner is to be forced to transfer onto the photosensitive drum per predetermined number of transfer mediums is made equal to 1.5 times the amount by which toner is borne on the toner supply roller 43 per rotation thereof. Therefore, not only is it possible to obtain images of good quality, that is, images satisfactory in that they do not suffer from fog and/or low density attributable to the toner deterioration in the developing apparatus, but also, the photosensitive drum is always satisfactorily cleaned by the cleaning blade.

This embodiment was described with reference to a setup in which the image forming apparatus is operated in the forced transfer mode for every predetermined number (which is 100 in this embodiment) of transfer mediums. However, the predetermined value Pfix does not need to be limited to the value in this embodiment; it may be adjusted as necessary according to the structure of the developing apparatus, and the durability of the toner used for image formation. Further, the image forming apparatus may be structured so that the length of time the developing apparatus is operated in the normal image formation mode is cumulatively measured, and the image forming apparatus is operated in the forced transfer mode each time the cumulative usage time reaches a predetermined value.

Also in this embodiment, the width, in terms of the secondary scanning direction, by which the photosensitive drum 2 is to be exposed by the exposing apparatus 1 while the image forming apparatus is operated in the second forced transfer mode is made equal to 1.5 times the circumference of the toner supply roller 43. However, it may be adjusted as necessary according to the diameter and peripheral velocity of the development roller 42, or the diameter and peripheral velocity of the toner supply roller 43. In other words, as long as the amount by which toner is to be forced to transfer onto the photosensitive drum 2 is no less than the amount by which toner is borne on the peripheral surface of the development roller 42 or the peripheral surface of the toner supply roller 43 per rotation thereof, the object of initializing the developing apparatus 4 can be accomplished to ensure that images of good quality, that is, images satisfactory in that they do not suffer from the fog and/or low density, will be continuously outputted.

Also in this embodiment, a temperature of 15° C. is selected as the first threshold value referenced to determine whether or not the internal temperature of the image forming apparatus is low enough to moderately reduce the cleaning blade 51 in resiliency, and a temperature of 10° C. is selected as the second threshold value reference to determine whether or not the internal temperature is low enough to drastically reduce the cleaning blade 51 in resiliency. The two temperatures 15° C. and 10° C. were selected based on the results, shown in Table 2, of the following experiment, in which the ambience detection sensor 12 was removed from the image forming apparatus; the temperature was changed from 7.5° C. to 17.5° C., by an increment of 2.5° C.; the amount by which toner was forced to transfer onto the photosensitive drum 2 each time the image forming apparatus was operated in the second forced transfer mode was varied from the value equal to 1 to 2.5 times the amount by which toner was borne on the supply roller 43 per rotation thereof, by an increment of 0.5 times the amount by which toner is borne on the supply roller 43 per rotation thereof; and under each condition, 5,000 copies were made to study the occurrences of the unsatisfactory cleaning of the photosensitive drum 2. Incidentally, the predetermined values Tfix1 and Tfix2 are optional; they may be changed in accordance with the properties of the cleaning blade.

TABLE 2

| | | Temperature T (° C.) | | | | |
|---|---|---|---|---|---|---|
| | | 7.5 | 10 | 12.5 | 15 | 17.5 |
| Amount of Transferred Toner per Forced Transfer (per × Rotations of Supply Roller | 1 | N | FN | G | G | G |
| | 1.5 | N | N | F | G | G |
| | 2 | N | N | F | G | G |
| | 2.5 | N | N | FN | F | G |

G: No improper cleaning
F: Slight improper cleaning is observed.
FN: Improper cleaning is seen.
N: Improper cleaning is remarkable.

Embodiment 6

Also in this embodiment, the image forming apparatus is operated in the three different forced transfer modes, that is, the second forced transfer mode, forced transfer mode for recovery, and preventive forced transfer mode, similar to those in the fifth embodiment. However, the sixth embodiment is different from the fifth embodiment in that humidity value is used as the threshold value referenced to regulate the amount by which toner is forced to transfer onto the photosensitive drum 2 each time the image forming apparatus is operated in the forced transfer mode.

The components of the image forming apparatus and process cartridge in this embodiment, which are identical to those in the above described embodiments are given the same referential symbols as those given in the description of these embodiments, and will not be described in detail here.

As for the amount of triboelectric charge the toner 41 acquires, it is affected by the changes in ambient humidity. That is, the lower the ambient humidity, the greater the amount by which the toner 41 acquires triboelectric charge. In this embodiment, therefore, in order to prevent the toner from slipping past the cleaning blade 51 when the ambient humidity is low, the image forming apparatus is structured so that when the ambient humidity is low, toner will be forced to transfer onto the photosensitive drum by a smaller amount than otherwise. Next, referring to FIGS. 9 and 12, the structure of this image forming apparatus will be described.

Referring to FIG. 9, also in this embodiment, to the controlling means 21, an exposure timer 19 for measuring the length of time the photosensitive drum is exposed while the image forming apparatus is operated in the second forced transfer mode, is connected, and the deficiency in the exposure time relative to the referential length of exposure time in the second forced transfer mode is recorded. The length of exposure time in the second forced transfer mode here means the length of time the photosensitive drum 2 is actually exposed to a beam of laser light while the image forming apparatus is operated in the second forced transfer mode.

More specifically, in the second forced transfer mode, a latent image, different from the latent image formed in accordance with the image formation data inputted from a host computer or the like, is formed, by exposing the photosensitive drum 2 by the exposing apparatus 1 across the entire range of the photosensitive drum 2 in terms of the primary scanning direction, and by a predetermined width in terms of the secondary scanning direction. Then, the toner 41 in the developing apparatus 4 is transferred onto the photosensitive drum 2 by applying development bias to the developing apparatus 4. As a result, the toner 41 in the developing apparatus 4 is initialized.

The toner 41 having been transferred onto the photosensitive drum 2 while the image forming apparatus was operated in the second forced transfer mode is recovered into the cleaning apparatus 5 as the photosensitive drum 2 is rotated. During this rotation of the photosensitive drum 2, the toner 41 is moved past the transfer charging device 6, without the presence of the transfer medium 7 between the toner 41 and transfer charging device 6, and therefore, in order to prevent the transfer charging device 6 from being soiled, the transfer bias voltage Vtr is set to 0 V (Vtr=0).

Also in this embodiment, in order to make it possible to simultaneously force both the toner on the development roller 42 and the toner on the toner supply roller 43 to transfer onto the photosensitive drum 2, it is desired that the width, in terms of the secondary scanning direction, by which the photosensitive drum 2 is exposed by the exposing apparatus 1 while the image forming apparatus is operated in the second forced transfer mode, is made to be no less than the circumference (33.4 mm) of the development roller 42, or the circumference (41.8 mm) of the toner supply roller 43.

In this case, the length of exposure time in the forced transfer mode is 0.6 second. Therefore, the aforementioned referential length of exposure time for the exposure timer 19 in this embodiment is 0.6 second.

Also in this embodiment, not only is the exposure timer 19 connected to the controlling means 21, but also, the ambience detection sensor 12 is connected to the controlling means 21 to detect the internal ambience of the image forming apparatus. In this embodiment, the ambience detection sensor 12 detects the internal humidity of the image forming apparatus, enabling the controlling means 21 to constantly determine whether or not the internal humidity of the image forming apparatus is higher than the predetermined value.

In other words, in this embodiment, the internal temperature of the image forming apparatus is used as the referential factor, which in the fifth embodiment was the internal temperature. That is, when the internal humidity of the image forming apparatus is no more than the predetermined value, the image forming apparatus is operated in two different modes; either the image forming apparatus is prevented from being operated in the forced transfer mode for every 100 copies, or is operated in the forced transfer mode, for every 100 copies, in which the amount by which toner is forced to transfer per transfer is smaller than that in the second forced transfer mode.

More concretely, two humidity levels of 30% RH and 10° C. RH are selected as the threshold values, which are referenced to determine whether or not the internal humidity of the image forming apparatus is low enough to increase the toner in the amount of triboelectric charge. That is, a humidity value of 30% RH is used as the threshold (referential) value below which the toner moderately increases in the amount of the triboelectric charge, whereas a humidity value of 15% RH is used as the threshold (referential) value below which the toner drastically increases in the amount of triboelectric charge. Thus, when the internal humidity of the image forming apparatus is no Lo more than 30% RH, but higher than 15% RH, the amount by which toner is to be forced to transfer onto the photosensitive drum in the second forced transfer mode is reduced from the value proportional to 1.5 times the circumference of the toner supply roller 43 to a value proportional to the circumference (41.8 mm) of the development roller 42, whereas when the internal humidity is no more than 10% RH, which is the lower of the two referential values, the image forming apparatus is not operated in the forced transfer mode.

The above described arrangement is made for the reason similar to that in the fifth embodiment; it is made for preventing the problem that the increase in the amount of the triboelectric charge of the toner attributable to the decrease in the ambient humidity allows the toner 41 to slip past the cleaning blade 51. As will be evident from the above description of this embodiment, by making smaller the amount by which toner is forced to transfer from the developing apparatus 4 onto the photosensitive drum in the low humidity ambience, the frequency at which the photosensitive drum is unsatisfactorily cleaned in the low humidity ambience can be reduced.

Hereafter, the forced transfer mode in which the amount by which toner is forced to transfer onto the photosensitive drum per transfer is smaller than that in the second forced transfer mode will be called the preventive forced transfer mode, as it was in the fifth embodiment, in which the temperature value was used as the referential value.

It is possible that the amount by which toner is expelled from the developing apparatus 4 in the preventive forced transfer mode is smaller than that in the second forced transfer mode, and also, it is possible that if the image forming apparatus is prevented from being operated in the forced transfer mode, the deteriorated toner accumulates in the developing apparatus 4. Therefore, also in this embodiment, the exposure timer 19 is employed to measure the length of time the photosensitive drum would have been exposed if the image forming apparatus were operated in the second forced transfer mode in the low humidity ambience.

In this embodiment, each time toner is forced to transfer while the image forming apparatus is operated in the preventive forced transfer mode, 0.2 second is added to the value in the exposure timer 19, whereas when the image forming apparatus is prevented from being operated in the forced transfer mode for every 100 copies, 0.6 second is added to the value in the exposure timer 19.

As described above, when the internal humidity of the image forming apparatus is no less than the predetermined value, and also, the value in the exposure timer 19 is zero, the image forming apparatus in this embodiment is operated in the second forced transfer mode. However, when the value in the exposure timer 19 is greater than zero, the image forming apparatus is operated in the forced transfer mode for recovery, in which the amount by which toner is forced to transfer per transfer is greater than that in the second forced transfer mode, until the value in the exposure timer 19 reduces to zero.

More specifically, when the internal humidity of the image forming apparatus is no less than 30% RH, and also, the value in the exposure timer 19 is greater than zero, the amount by which the toner 41 is forced to transfer per transfer is set to a value proportional to 83.6 mm, or twice the circumference of the toner supply roller 43, whereas in the second forced transfer mode, it is set to a value proportional to 1.5 times the peripheral surface of the toner supply roller 43.

By operating the image forming apparatus in this forced transfer mode for recovery, it is possible to prevent the exacerbation of the toner deterioration in the developing apparatus, which occurs because the amount by which toner is forced to transfer in the preventive forced transfer mode is smaller.

Regarding the amount by which toner is to be forced to transfer onto the photosensitive drum 2 per transfer when the internal ambience of the image forming apparatus is not the low temperature/low humidity ambience, when it was equal to 1-1.5 times the amount by which toner was borne on the toner supply roller 43 per rotation thereof, there was no noticeably unsatisfactory cleaning of the photosensitive drum. However, when it was no less than twice the amount by which toner was borne on the toner supply roller 43 per rotation thereof, the cleaning blade became overloaded at a temperature level (which in this embodiment is about 15° C.) below which rubber reduced in resiliency, allowing the photosensitive drum to be noticeably unsatisfactorily cleaned. Therefore, even in the forced transfer mode for recovery, the amount by which toner is forced to transfer is set to a value no greater than twice the amount by which toner is borne on the toner supply roller 43 per rotation thereof.

Figure 12:
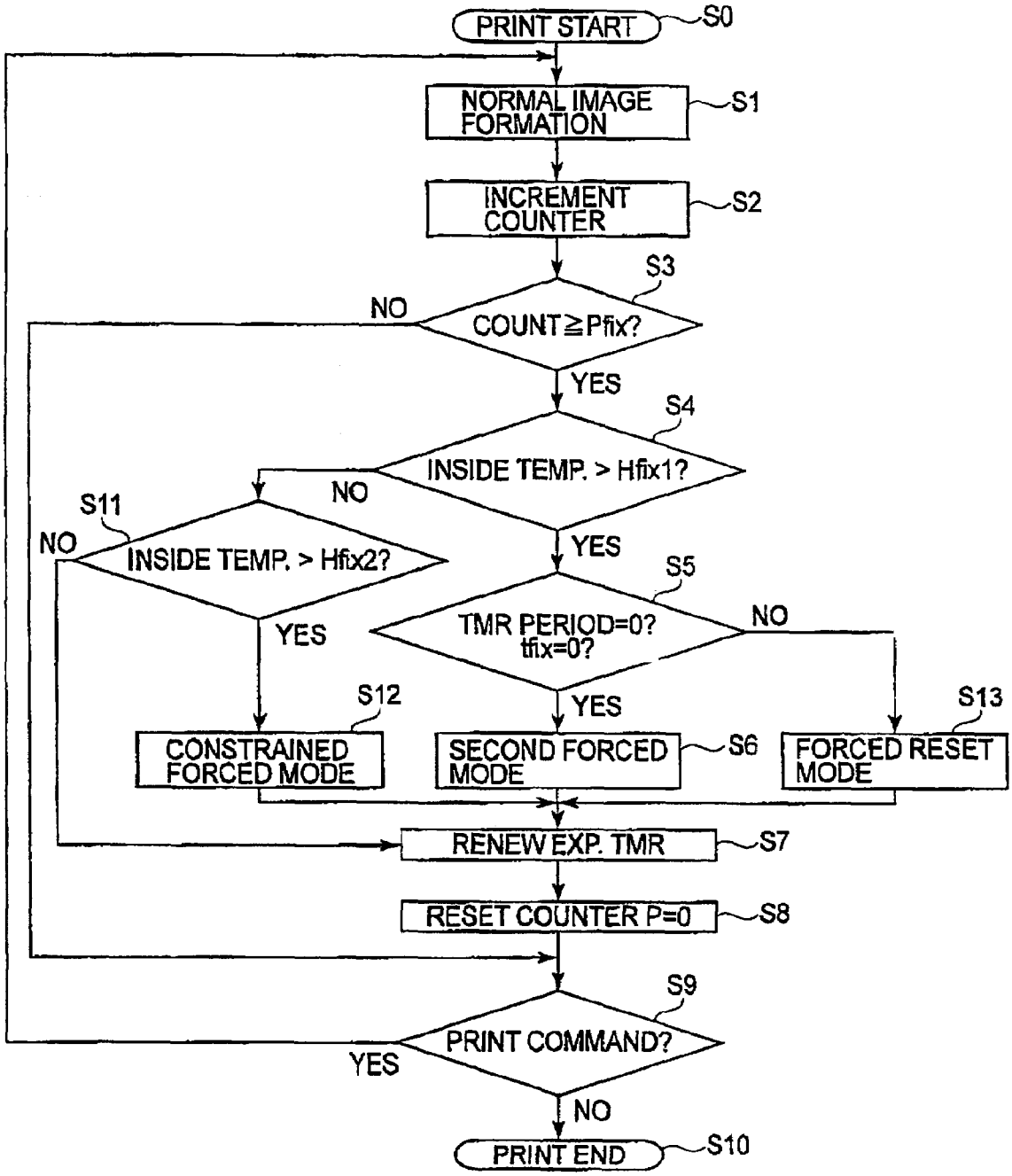
FIG. 12 is a flowchart of another example of the developer transfer controlling process in accordance with the present invention.

FIG. 12 is the flowchart of the image forming operation carried out by the image forming apparatus in this embodiment, which will be described next.

As a printing operation is started (S0), the image forming apparatus is operated in the normal image formation mode (S1), and one is added to the value P in the counter 20 (S2).

Then, the controlling means 21 determines whether or not the value P in the counter 20 is no less than the predetermined value Pfix (S3). When the value P in the counter 20 is no more than Pfix, the controlling means 21 determines whether there is a print demand or not (S9). When there is a print demand, the image forming apparatus is operated in the normal image formation mode (S1). In this embodiment, the predetermined value Pfix is 100 (Pfix=100).

When there is no print demand, the printing operation is ended (S10). When the controlling means 21 determines that the value P in the counter 20 is no less than the predetermined value Pfix, which in this embodiment is 100 (S3), the controlling means 21 determines whether the internal humidity H of the image forming apparatus detected by the ambience detection sensor 12 is greater than the predetermined value Hfix1 (S4). In this embodiment, Hfix1 is 30% RH.

When the internal humidity H detected by the ambience detection sensor 12 is greater than the predetermined value Hfix1, the controlling means 21 determines whether or not the value t in the exposure timer 19 is zero (S5).

When the value t in the exposure timer 19 is greater than zero (t>0), the image forming apparatus is operated in the forced transfer mode for recovery (S13), whereas when the value t in the exposure timer 19 equals zero (t=0), the image forming apparatus is operated in the second forced transfer mode (S6), and the value in the exposure timer 19 is renewed (S7). Then, the counter 20 is reset; the value P in the counter 20 is changed to zero (P=0) (S8). In this embodiment, the length of exposure time in the forced transfer mode for recovery is set to 1.1 seconds, which is the length of time it takes for the toner supply roller 43 to rotate three times, and the length of exposure time in the second forced transfer mode is set to 0.6 second, which is the length of time it takes for the toner supply roller 43 to rotate 1.5 times.

Thereafter, it is determined whether there is a print demand or not (S9). When there is a print demand, the image forming apparatus is operated in the normal image formation mode (S1). When the internal humidity H of the image forming apparatus detected by the ambience detection sensor 12 is no more than the predetermined value Hfix1, it is determined whether or not the internal humidity H is higher than the predetermined second value Hfix2 (S11). In this embodiment, the second predetermined value Hfix2 is 10% RH.

When the internal humidity H of the image forming apparatus is higher than the predetermined value Hfix2, the image forming apparatus is operated in the preventive forced transfer mode (S12), and the value in the exposure timer 19 is renewed (S7). Then, the transfer medium counter 20 is reset; the value P in the counter 20 is changed to zero (S8). In this embodiment, the length of exposure time in the preventive forced transfer mode is set to 0.4 second, which is the length of time it takes for the toner supply roller 43 to rotate once.

Then, it is determined whether or not there is a print demand (S9). When there is a print demand, the image forming apparatus is operated in the normal image formation mode (S1).

When the internal humidity H is no more than the predetermined value Hfix2, the value t in the exposure timer 19 is renewed without operating the image forming apparatus in the forced transfer mode. Then, it is determined whether or not there is a print demand (S9).

When the internal humidity H is no more than the predetermined value Hfix2, the image forming apparatus is not operated in the forced transfer mode. However, even when the internal humidity H is no more than the predetermined value Hfix2, one is added to the value P in the counter 20 each time an image is formed in the normal image formation mode. Therefore, an arrangement is made so that when the internal humidity H is higher than the predetermined value Hfix2, the image forming apparatus is operated in the forced transfer mode.

In an experiment in which the image forming apparatus in this embodiment was used several days during the winter, outputting roughly 5,000 copies, in an office in which internal humidity in the range of 20% RH-50% RH, not only did the unsatisfactory cleaning of the photosensitive drum 2 not occur even once, but also, satisfactory images, that is, images satisfactory in that they did not suffer from such problems as the low density and/or fog, were continuously formed.

As described above, in the case of the image forming apparatus in this embodiment, (1) when the internal humidity of the image forming apparatus is lower than the first predetermined value (second ambience), the deteriorated toner is forced to transfer onto the photosensitive drum by a smaller amount than otherwise; (2) when the internal humidity of the image forming apparatus is lower than the predetermined second predetermined value, which is smaller than the first predetermined value (second ambience), the process of transferring the deteriorated toner onto the photosensitive drum 2 is not carried out; (3) when the internal humidity of the image forming apparatus is higher than the predetermined value (first ambience), and also, the length of time the photosensitive drum is exposed in the forced transfer mode is smaller than the length of time by which the photosensitive drum would have been exposed if the developer were forced to transfer onto the image bearing member during the period in which no image is formed, the amount by which toner is to be forced to transfer onto the photosensitive drum is increased to compensate for the deficiency in the exposure time; (4) when the internal humidity of the image forming apparatus is higher than the predetermined value (first ambience), and also, the length of time the photosensitive drum is exposed in the forced transfer mode is not shorter than the length of time the photosensitive drum would have been exposed if the developer were forced to transfer from the developing apparatus onto the photosensitive drum during the period in which no image is formed, the amount by which the deteriorated toner is to be forced to transfer onto the photosensitive drum per predetermined number of transfer mediums is made equal to 1.5 times the amount by which toner is borne on the toner supply roller 43 per rotation thereof. Therefore, not only is it possible to obtain images of good quality, that is, images satisfactory in that they do not suffer from the fog and/or low density attributable to the toner deterioration in the developing apparatus, but also, the photosensitive drum is always satisfactorily cleaned by the cleaning blade.

Also in this embodiment, a relative humidity value of 30% RH below which toner is moderately greater in the amount of triboelectric charge, and a relative humidity value of 10% RH below which toner is substantially greater in the amount of the triboelectric charge, are selected as the threshold values (referential values), based on Table 3, given below, which shows the results of an experiment, in which the ambience detection sensor 12 was removed from the image forming apparatus; the temperature was kept at 25° C.; relative humidity was varied from 5% RH to 40% RH, with an increment of 10% RH, except for an increment of 5% RH between 5% RH and 10% RH; amount by which toner was forced to transfer onto the photosensitive drum 2 each time the image forming apparatus was operated in the second forced transfer mode was varied from the value equal to 1 to 2.5 times the amount by which toner is borne on the supply roller 43 per rotation thereof, by an increment of 0.5 times the amount by which toner is borne on the supply roller 43 per rotation thereof; and under each condition, 5,000 copies were outputted to study the occurrences of the unsatisfactory cleaning of the photosensitive drum 2. The predetermined values Hfix1 and Hfix2 are optional; they may be changed in accordance with the properties of the cleaning blade.

TABLE 3

| | | Humidity H (%) | | | | |
|---|---|---|---|---|---|---|
| | | 5 | 10 | 20 | 30 | 40 |
| Amount of Transferred Toner per Forced Transfer (per × Rotations of Supply Roller | 1 | N | N | G | G | G |
| | 1.5 | N | FN | F | G | G |
| | 2 | N | N | F | G | G |
| | 2.5 | N | N | N | F | G |

G: No improper clearning
F: Slight improper cleaning is observed.
FN: Improper cleaning is seen.
N: Improper cleaning is remarkable.

The controlling method in the fifth embodiment, in which the forced transfer mode in which the image forming apparatus is operated when the internal temperature of the image forming apparatus is low is adjusted in two steps, and the controlling method in the sixth embodiment, in which the forced transfer mode in which the image forming apparatus is operated when the internal humidity of the image forming apparatus is low, are also applicable to the forced transfer modes in the first, second, and third embodiments which do not use the exposure timer.

The developing apparatuses in the first to sixth embodiments were provided with the developer bearing member and developer supplying member. However, developing apparatus structure does not need to be limited to one of the structures of those developing apparatuses. For example, the present invention is applicable to a developing apparatus which is not provided with the developer supplying member. In the case of the developing apparatus with no developer supplying member, the amount by which developer is forced to transfer in the forced transfer mode is the same as the amount by which developer is borne on the developer bearing member per rotation thereof.

The measurements, materials, and shapes of the structural components of the image forming apparatuses described above, and the positional relationships among them, are not intended to limit the scope of the present invention, unless specifically noted.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 006883/2004, filed Jan. 14, 2004, which is hereby incorporated by reference.

What is claimed is:

1. An image forming apparatus comprising:

an image bearing member;

a developing device for developing an electrostatic image formed on said image bearing member with a developer into a developed image;

transferring means for transferring the developed image onto an image receiving member;

cleaning member, contacted to said image bearing member, for removing a residual developer from said image bearing member;

detecting means for detecting an ambient condition of said apparatus;

wherein said developing device is capable of transferring a developer onto a non-image formation region of said image bearing member, wherein the non-image formation region is a region from which no developer is transferred onto the image receiving member, wherein the developer on the non-image formation region reaches a cleaning position of said cleaning member, and wherein an operation of transferring the developer onto the non-image formation region is different when an output of said detecting means is indicative of a temperature not higher than a predetermined temperature then when an output of said detecting means is indicative of a temperature higher than the predetermined temperature and is indicative of a humidity not higher than a predetermined humidity.

2. An apparatus according to claim 1, wherein said developing device comprises a rotatable developer carrying member for carrying the developer to a developing position for said image bearing member, and said developing device is capable of transferring the developer onto the non-image formation region for a time period corresponding to not less than one full-turn of said developer carrying member.

3. An apparatus according to claim 2, wherein the time period corresponds to not less than one full-turn of said developer carrying member when said detecting means detects a first ambient condition, and corresponds to less than one full-turn of said developer carrying member when said detecting means detects a second ambient condition.

4. An apparatus according to claim 3, wherein the ambient condition is a temperature or a humidity, and the first ambient condition corresponds to a temperature or humidity which is higher than a predetermined level, and the second ambient condition corresponds to a temperature or humidity which is not higher than the predetermined level.

5. An apparatus according to claim 1, wherein said developing device comprises a rotatable developer carrying member for carrying the developer to a developing position for said image bearing member, and said developing device is capable of transferring the developer onto the non-image formation region for a time period corresponding to not less than one full-turn of said developer carrying member.

6. An apparatus according to claim 5, wherein the time period corresponds to not less than one full-turn of said developer carrying member when said detecting means detects a first ambient condition, and corresponds to less than one full-turn of said developer carrying member when said detecting means detects a second ambient condition.

7. An apparatus according to claim 6, wherein the ambient condition is a temperature or a humidity, and the first ambient condition corresponds to a temperature or humidity which is higher than a predetermined level, and the second ambient condition corresponds to a temperature or humidity which is not higher than the predetermined level.

8. An apparatus according to claim 3, 4, 6 or 7, wherein an amount of transfer of the developer onto the non-image formation region by said developing device in the first ambient condition upon change of the ambient condition from the second ambient condition to the first ambient condition, is larger than an amount of transfer of the developer onto the non-image formation region by said developing device in the first ambient condition without the change.

9. An apparatus according to claim 8, wherein an amount of transfer of the developer onto the non-image formation region by said developing device is changeable by changing an area on said image bearing member exposed to the light by said exposure device, and a sum of two of exposed areas in said first and second ambient conditions respectively upon change of the ambient condition from the second ambient condition to the first ambient condition, is substantially the same as a sum of two of exposed areas in the first ambient condition without the change of the ambient condition.

10. An apparatus according to claim 3, 4, 6 or 7, wherein in the second ambient condition, the amount of the developer transferred onto the non-image formation region by said developing device is decreased step by step in accordance with the output of said detecting means.

11. An apparatus according to claim 3, 4, 6 or 7, wherein the developing device does not operate to transfer the developer onto the non-image formation region when the output of said detecting means is indicative of the second ambient condition.

12. An apparatus according to claim 1, wherein said image bearing member is a photosensitive member, and said image forming apparatus comprises an exposure device for exposing said image bearing member to light to form the electrostatic image, and wherein said exposure device exposes said image bearing member to the light so as to provide a region for receiving the developer in the non-image formation region of said image bearing member.

13. An apparatus according to claim 1, wherein an amount of transfer of the developer onto the non-image formation region by said developing device is changeable by changing an area on said image bearing member exposed to the light by said exposure device.

14. An apparatus according to claim 1, wherein an amount of transfer of the developer onto the non-image formation region by said developing device is changeable by changing a voltage applied to a developer carrying member of said developing device.

15. An apparatus according to claim 1, wherein an amount of transfer of the developer onto the non-image formation region by said developing device is changeable by changing a driving speed of a developer carrying member of said developing device.

16. An apparatus according to claim 1, wherein timing at which said developing device transfers the developer onto the non-image formation region is determined on the basis of a number of image formations, an exposure time duration by an exposure device in the image formation, or a time duration of a developing operation of said developing device.

17. An apparatus according to any one of claims 1-2 and 5-15, wherein the developing device does not operate to transfer the developer onto the non-image formation region when the output of said detecting means is within a predetermined range.

18. An apparatus according to claim 1, wherein an amount of the developer transferred onto the non-image formation region is smaller when the temperature is not higher than the predetermined temperature, than when the temperature is higher than the predetermined temperature and the humidity is not higher than the predetermined humidity.

19. An apparatus according to claim 18, wherein the operation of transferring the developer onto the non-image formation region is prohibited when the output of said detecting means is indicative of a temperature not higher than the predetermined temperature.

20. A apparatus according to claim 18, wherein the amount of the developer transferred onto the non-image formation region when the output of said detecting means is indicative of the temperature higher than the predetermined temperature and the humidity higher than the predetermined humidity, is larger than when the temperature is higher than the predetermined temperature and the humidity is not higher than the predetermined humidity.

* * * * *

UNITED STATES PATENT AND TRADEMARK OFFICE

CERTIFICATE OF CORRECTION

PATENT NO. : 7,272,331 B2
APPLICATION NO. : 11/033735
DATED : September 18, 2007
INVENTOR(S) : Tetsuya Kobayashi et al.

It is certified that error appears in the above-identified patent and that said Letters Patent is hereby corrected as shown below:

COLUMN 11:
Line 4, “different the” should read --different than the--; and
Line 27, “force” should read --forced--.

COLUMN 14:
Line 53, “a’s” should read --as--.

COLUMN 15:
Line 45, “to discharged” should read --to be discharged--.

COLUMN 16:
Line 48, “and” should be deleted.

COLUMN 18:
Line 9, “by toner” should read --by which toner--.

COLUMN 26:
Line 14, “times” should read --timer--; and
Line 17, “changes,” should read --change,--.

COLUMN 28:
Line 53, “time” should read --times--.

COLUMN 29:
Line 15, “loss” should read --less--.

COLUMN 31:
Line 44, “thereof; (2)” should read --thereof; and (2)--; and
Line 53, “More over,” should read --Moreover,--.

COLUMN 34:
Line 62, “force” should read --forced--.

COLUMN 39:
Line 63, “Lo” should be deleted.

COLUMN 42:
Line 36, “humidity in” should read --humidity was in--.

UNITED STATES PATENT AND TRADEMARK OFFICE

CERTIFICATE OF CORRECTION

PATENT NO. : 7,272,331 B2
APPLICATION NO. : 11/033735
DATED : September 18, 2007
INVENTOR(S) : Tetsuya Kobayashi et al.

It is certified that error appears in the above-identified patent and that said Letters Patent is hereby corrected as shown below:

COLUMN 43:

In Table 3, Line 50, "G: No improper clearning" should read --G: No improper cleaning--.

COLUMN 44:

Line 32, "member;" should read --member; and--;
Line 47, "temperature" should read --temperature,--;
Line 48, "then" should read --than--.

COLUMN 45:

Line 37, "conditions" should read --conditions,--.

COLUMN 46:

Line 28, "claims 1-2 and" should read --claims 1, 2, 5 to 7 and--; and
Line 29, "5-15," should read --12 to 15,--.

Signed and Sealed this

Twentieth Day of May, 2008

JON W. DUDAS
*Director of the United States Patent and Trademark Office*